US008177313B2

(12) United States Patent
Suzuki et al.

(10) Patent No.: US 8,177,313 B2
(45) Date of Patent: May 15, 2012

(54) IMAGE FORMING APPARATUS

(75) Inventors: Kazuki Suzuki, Kanagawa (JP); Yasuhiro Kawashima, Kanagawa (JP); Isamu Kubo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 303 days.

(21) Appl. No.: 12/665,898

(22) PCT Filed: Oct. 17, 2008

(86) PCT No.: PCT/JP2008/069294

§ 371 (c)(1),
(2), (4) Date: Dec. 21, 2009

(87) PCT Pub. No.: WO2009/066540

PCT Pub. Date: May 28, 2009

(65) Prior Publication Data

US 2010/0321426 A1 Dec. 23, 2010

(30) Foreign Application Priority Data

Nov. 22, 2007 (JP) ..... 2007-303157

(51) Int. Cl.
*B41J 2/195* (2006.01)

(52) U.S. Cl. ..... 347/7

(58) Field of Classification Search ..... 347/7, 84, 347/85

See application file for complete search history.

(56) References Cited

U.S. PATENT DOCUMENTS

| | | | | |
|---|---|---|---|---|
| 7,077,495 | B2 | 7/2006 | Kawashima | |
| 7,841,706 | B2 * | 11/2010 | Ishinaga et al. | 347/84 |
| 2001/0024225 | A1 | 9/2001 | Ishizawa et al. | |
| 2002/0024543 | A1 | 2/2002 | Kimura et al. | |
| 2002/0089576 | A1 | 7/2002 | Ishizawa et al. | |
| 2002/0093556 | A1 | 7/2002 | Ishizawa et al. | |
| 2002/0130932 | A1 | 9/2002 | Harada et al. | |
| 2005/0104927 | A1 | 5/2005 | Kudoh et al. | |
| 2005/0146554 | A1 | 7/2005 | Asanuma et al. | |
| 2005/0189895 | A1 | 9/2005 | Muroi | |
| 2005/0194730 | A1 | 9/2005 | Nishida et al. | |
| 2006/0181569 | A1 | 8/2006 | Kawashima et al. | |

(Continued)

FOREIGN PATENT DOCUMENTS

EP 1142713 A2 10/2001

(Continued)

OTHER PUBLICATIONS

Jun. 20, 2011 European search report in connection with counterpart European patent application No. 08 85 1552.

*Primary Examiner* — An Do
(74) *Attorney, Agent, or Firm* — Cooper & Dunham LLP

(57) ABSTRACT

An image forming apparatus includes a print head to eject droplets, a subtank to supply ink to the print head, a main tank to supply the ink to the subtank, a supply pump to supply the ink from the main tank to the subtank, a pump driver to drive the supply pump, an amount sensor to sense an ink amount in the subtank and output a signal when the ink amount in the subtank is at a predetermined level, and a unit to drive and control the pump driver, which is configured to decrease an ink supply rate of the supply pump in response to the signal outputted by the amount sensor and to stop the supply pump when predetermined time has passed after the signal is outputted by the amount sensor.

11 Claims, 24 Drawing Sheets

U.S. PATENT DOCUMENTS

| | | | |
|---|---|---|---|
| 2006/0187504 | A1 | 8/2006 | Kawashima |
| 2006/0209099 | A1 | 9/2006 | Kawashima |
| 2007/0171253 | A1 | 7/2007 | Kudoh et al. |
| 2007/0279462 | A1 | 12/2007 | Ishizawa et al. |
| 2008/0231653 | A1 | 9/2008 | Kawashima et al. |

FOREIGN PATENT DOCUMENTS

| | | |
|---|---|---|
| JP | 57-43888 | 3/1982 |
| JP | 1-125581 | 5/1989 |
| JP | 11-346491 | 12/1999 |
| JP | 2001-187463 | 7/2001 |
| JP | 2001-270133 | 10/2001 |
| JP | 2002-1980 | 1/2002 |
| JP | 2002-273898 | 9/2002 |
| JP | 2002-301826 | 10/2002 |
| JP | 2005-59274 | 3/2005 |
| JP | 2005-219376 | 8/2005 |
| JP | 2006-123365 | 5/2006 |
| JP | 2006-224392 | 8/2006 |
| JP | 2006-264239 | 10/2006 |
| JP | 2007-15153 | 1/2007 |
| JP | 2007-50565 | 3/2007 |
| JP | 2007-56192 | 3/2007 |
| JP | 2007-90558 | 4/2007 |
| JP | 2007-105935 | 4/2007 |
| JP | 2008-49631 | 3/2008 |

* cited by examiner

500
CPU
501
ROM
502
RAM
503
NV RAM
504
HOST I/F
506
SCANNER CONTROLLER
516
ASIC
505
I/O
513
PRINT CONTROLLER
508
MOTOR DRIVER
510
AC BIAS SUPPLIER
511
CARRIAGE
23
HEAD DRIVER
509
PRINT HEAD
24
HORIZONTAL SCANNING MOTOR
554
VERTICAL SCANNING MOTOR
581
PUMP DRIVING MOTOR
305
CARRY BELT
35
SUPPLY PUMP
301
CHARGED ROLLER
39
FEELER SENSOR
315
SENSOR ELECTRODE
210
TEMPERATURE SENSOR
515
IMAGE READ UNIT
2
OPERATION PANEL
514

IMAGE FORMING APPARATUS

TECHNICAL FIELD

The present invention relates to a print head capable of ejecting droplets and to an image forming apparatus having a subtank capable of supplying ink to the print head.

BACKGROUND ART

As image forming apparatuses such as printers, facsimile machines, copying machines, plotters, and multifunction peripherals including functions of these devices, for example, there are image forming apparatuses of a liquid ejection recording type, having a print head to eject ink droplets. As such image forming apparatuses, inkjet recording apparatuses and the like are widely known. In the image forming apparatuses of the liquid ejection recording type, ink droplets are ejected from the print head onto carried paper (OHP transparencies and the like are included, to which ink droplets, other liquid, and the like can adhere. These are also called a medium to be recorded, a recording medium, recording paper, a recording sheet, and the like) to form images (used to refer to recording, printing text, imaging, and printing). In serial image forming apparatuses of the liquid ejection recording type, images are formed by ejecting droplets from a print head moving in a horizontal direction. In line type image forming apparatuses of the liquid ejection recording type using a line head, droplets are ejected by a fixed line print head.

In the invention, the "image forming apparatus" means an apparatus to form images by ejecting liquid to a medium such as paper, a thread, a fiber, fabric, leather, metal, plastic, glass, wood, and ceramics. "Forming images" means not only to provide a medium with an image with a meaning such as text and figures, but also an image without a meaning such as a pattern (droplets are simply ejected onto a medium). Moreover, "ink" is not limited to regular known inks, but is a general term for all liquid which can be used for forming images.

A general structure of such an image forming apparatus of the liquid ejection type includes a subtank (also called a head tank or a buffer tank) serving as a small liquid container to supply ink to a print head provided on a carriage. A main tank with a large capacity (also called a main cartridge or an ink cartridge) is provided in a main body of the image forming apparatus to supply (charge) ink to the subtank.

For example, Patent Document 1 discloses an image forming apparatus having a subtank type ink supplier including an internal spring and at least one wall formed of a film material. In this apparatus, an open valve of the subtank is opened when ink is supplied to the subtank and the open valve is closed when a negative pressure is generated to eject the ink.

[Patent Document 1] Japanese Patent Application Publication No. 2005-059274

Patent Document 2 discloses an image forming apparatus having a displaceable negative pressure sensor lever which displaces in accordance with the negative pressure in a subtank, and a method to control the ink supply to the subtank by sensing the displacement of the negative pressure sensor lever by an optical sensor. If the optical sensor senses the negative pressure sensor lever, ink is sent from a main tank to the subtank.

[Patent Document 2] Japanese Patent Application Publication No. 2007-015153

Patent Document 3 discloses a technique to control driving and stopping of a driving motor by a supply pump driver circuit in response to a sensor signal from a sensor. The driving motor is stopped in response to a sensor signal of a load sensor which senses a load of the supply pump as a load of the driving motor.

[Patent Document 3] Japanese Patent Application Publication No. 2007-105935

Patent Document 4 discloses an image forming device having a valve unit which opens and closes an ink supply path from an ink tank to a print head. A valve controller determines time to open the valve so that ink is supplied at an amount corresponding to an ink amount ejected by the print head.

[Patent Document 4] Japanese Patent Application Publication No. 2007-050565

Patent Document 5 discloses an image forming apparatus having a pump to supply ink, a motor to drive the pump, and an input current supplier to supply the motor with an input current. A current value of the input current is changed in accordance with a position of a moving part of the pump in its movable area so that an operation rate of the moving part of the pump becomes constant in each cycle of the pump.

[Patent Document 5] Japanese Patent Application Publication No. 2006-264239

Patent Document 6 discloses a technique to determine the existence of ink in a subtank when the ink surface is sensed a predetermined number of times and determine the absence of ink in the subtank when the ink surface is not sensed the predetermined number of times.

[Patent Document 6] Japanese Patent Application Publication No. 2006-123365

In Patent Document 2, the negative pressure sensor lever which displaces in accordance with the ink supply is provided. When the optical sensor set at a desired level of the ink supply senses the negative pressure sensor lever, the supply motor to drive the supply pump is stopped to stop the ink supply. In this case, however, there is a delay in response of about several msec to several 100 msec after an instruction to stop the supply motor is made until the supply motor actually stops driving. Therefore, ink more than the desired level is supplied to the subtank during the response delay.

A detailed description is made with reference to FIG. 27. FIG. 27*a* shows a voltage applied to the driving motor to drive the supply pump and FIG. 27*b* shows a revolution of the driving motor. FIG. 27*c* shows a sensor signal outputted by the optical sensor as an amount sensor by sensing the negative pressure sensor lever which displaces in accordance with an ink amount in the subtank (the signal is outputted when the ink is at a predetermined amount). FIG. 27*d* shows an actual operation rate of the supply pump. As shown in FIG. 27, a driving voltage Vin1 is applied to drive the driving motor at a revolution of N1 and operate the supply pump at an operation rate of Vp1, thereby ink is supplied to the subtank. When the voltage supply to the driving motor is stopped by receiving the sensor signal inputted by the amount sensor, indicating that the ink is at a predetermined level, time is required until the supply pump actually stops operation. This time varies in the range from time Tts to Ttd. Ink continues to be supplied until the supply pump stops. FIG. 28 shows an example of using an amount sensor to sense an ink surface in the subtank, by which similar behavior is expected.

FIG. 29 shows a relationship among the voltage (driving voltage) applied to the driving motor which drives the supply pump, an ink supply rate (supply rate: a rate to supply ink to the subtank), and time required for the supply pump to stop. When the voltage (driving voltage) applied to the driving motor is raised to increase the ink supply rate, more time is required for the supply pump to stop. When the driving voltage applied to the driving motor is decreased to shorten the time required for the supply pump to stop, a desired ink supply rate (minimum amount of the ink supply) cannot be obtained (it takes time to supply the ink).

FIG. 30 shows the case of applying a relatively high driving voltage to the driving motor (here, a duty ratio is increased). In this case, time tdl is required for a motor driving rate to be zero after the driving voltage is set zero. In FIG. 31, the driving voltage applied to the driving motor is set relatively low (here, the duty ratio is decreased). In this case, time tds is required for the motor driving rate to be zero after the driving voltage is set zero. The time tdl is longer than the time tds (time required for the driving motor to stop varies too).

In this manner, ink more than the desired level is supplied to the subtank (too much ink supply) until the supply pump stops. The amount of the excessive ink supply varies depending on the variations of time required for the supply pump to stop. Moreover, when the supply pump is a piston pump, ink is supplied in a pulsated manner. Therefore, the final amount of ink supply varies largely from the desired level.

In this case, the variations in the amount of ink supply can be decreased by slowing down the ink supply rate as described above. With the slow ink supply rate, however, it takes longer to supply the ink, which also affects a recording rate. When the amount of ink supply largely varies, the ink may flow out of the subtank from the open valve. When the ink supply is stopped earlier to avoid the ink from flowing out of the subtank, the ink is not supplied to the full desired amount. As a result, the capacity of the subtank is not efficiently used.

DISCLOSURE OF THE INVENTION

It is an object of at least one embodiment of the invention to stabilize the ink supply amount without extending time required to supply ink from the main tank to the subtank.

According to one aspect of the invention, an image forming apparatus includes a print head to eject droplets, a subtank to supply ink to the print head, a main tank to supply the ink to the subtank, a supply pump to supply the ink from the main tank to the subtank, a pump driver to drive the supply pump, an amount sensor to sense an ink amount in the subtank and output a signal when the ink amount in the subtank is at a predetermined level, and a unit to drive and control the pump driver, which is configured to decrease an ink supply rate of the supply pump in response to the signal outputted by the amount sensor and to stop the supply pump when predetermined time has passed after the signal is outputted by the amount sensor.

According to at least one embodiment, when supplying the ink from the main tank to the subtank by using the supply pump driven by the pump driver, the pump driver is controlled so that the ink supply rate of the supply pump is decreased in response to the signal outputted by the amount sensor when the amount of ink in the subtank reaches a predetermined level. The ink supply by the supply pump is stopped when predetermined time has passed after the signal is outputted by the amount sensor. As a result, variations in the amount of ink supply can be reduced and the amount of ink supply can be stabilized without extending the time required for the main tank to supply ink to the subtank.

BEST MODE FOR CARRYING OUT THE INVENTION

Figure 1:
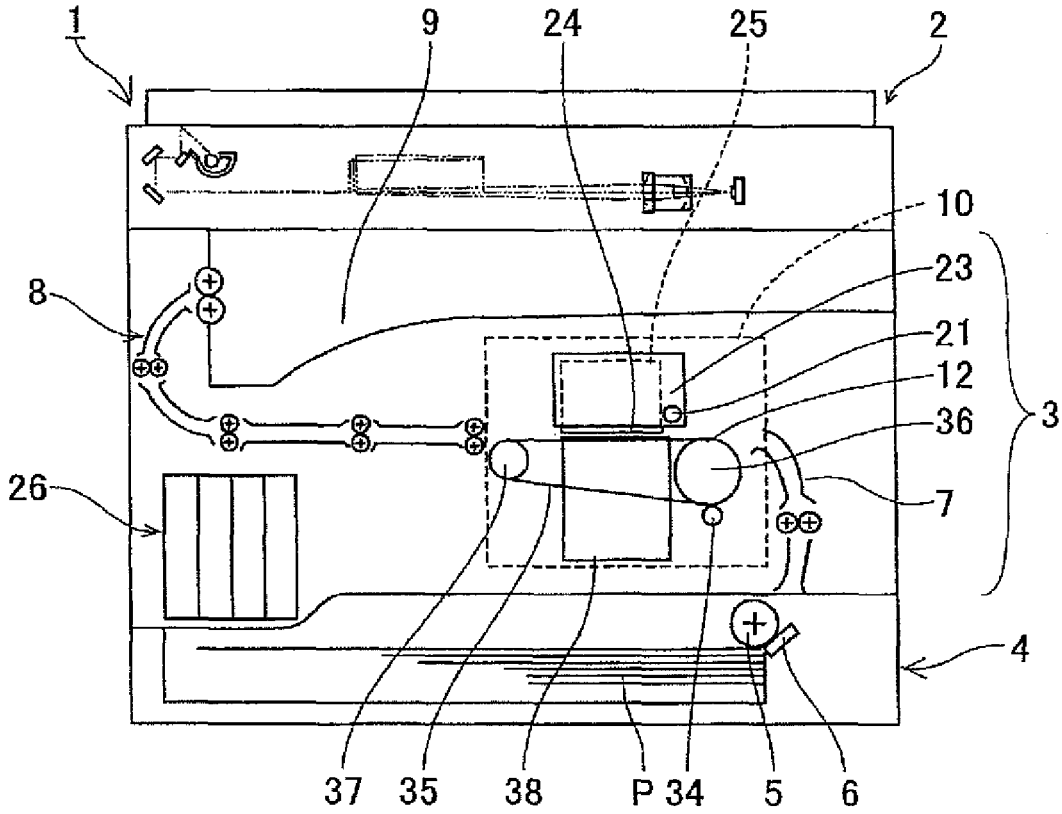
FIG. 1 is a schematic configuration view showing an overall configuration of an image forming apparatus of the invention.
Figure 2:
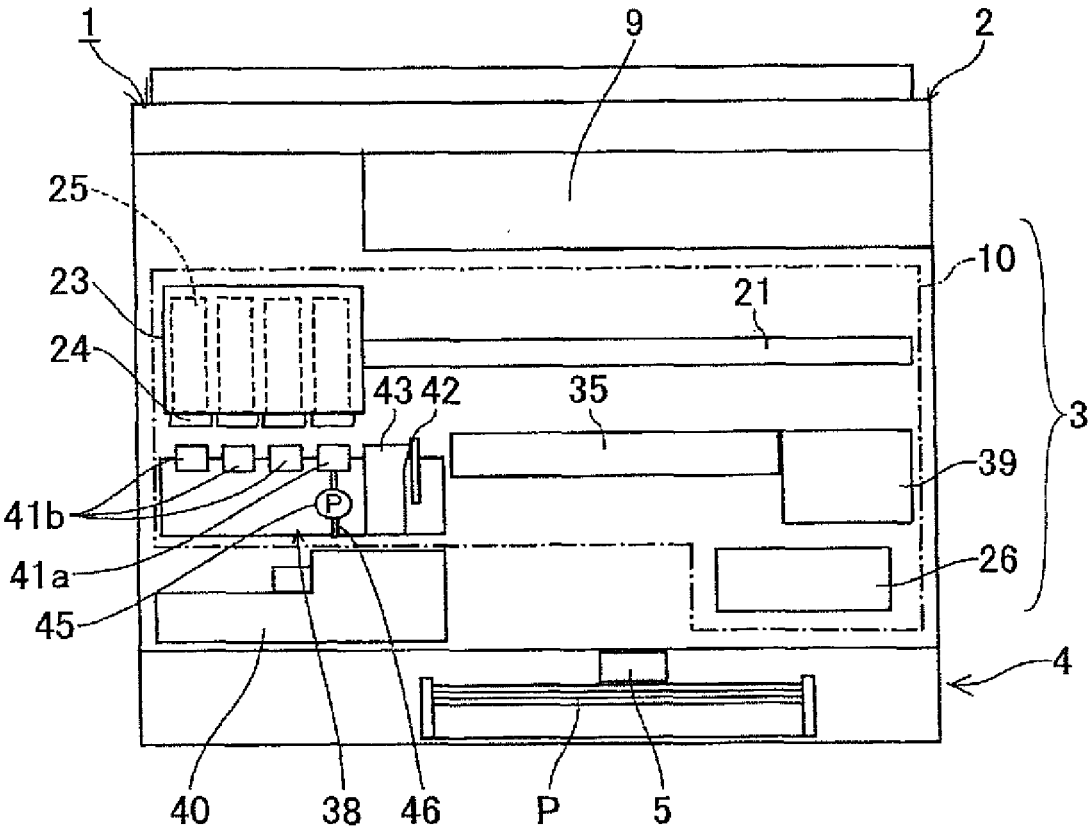
FIG. 2 is a view showing a left side of the image forming apparatus of FIG. 1.

A description of an embodiment of the invention will now be given with reference to the drawings. An example of an image forming apparatus of the invention is described with reference to FIGS. 1 to 4. FIG. 1 is an overall schematic configuration view of the image forming apparatus, FIG. 2 is a left side view of the image forming apparatus shown in FIG. 1, FIG. 3 is a perspective view of a printing unit of the image forming apparatus shown in FIG. 1, and FIG. 4 is a perspective view of the image forming apparatus of FIG. 1 seen from the bottom of a carriage.

This image forming apparatus is a copying machine with a main body 1 including an image read unit 2 such as a scanner to read in a document image, a recording unit 3 to form the image on a recording medium (hereinafter referred to as paper) P, and a feed cassette unit 4 to supply the paper P to the recording unit 3. The paper P stored in the feed cassette unit 4 is separated and fed one by one by a feeding roller 5 and a separation pad through a transfer path 7 to a printing unit 10. Then, a desired image is recorded onto the paper P, which is then discharged through a discharge path 8 and stacked in a discharged paper stack unit 9.

Figure 3:
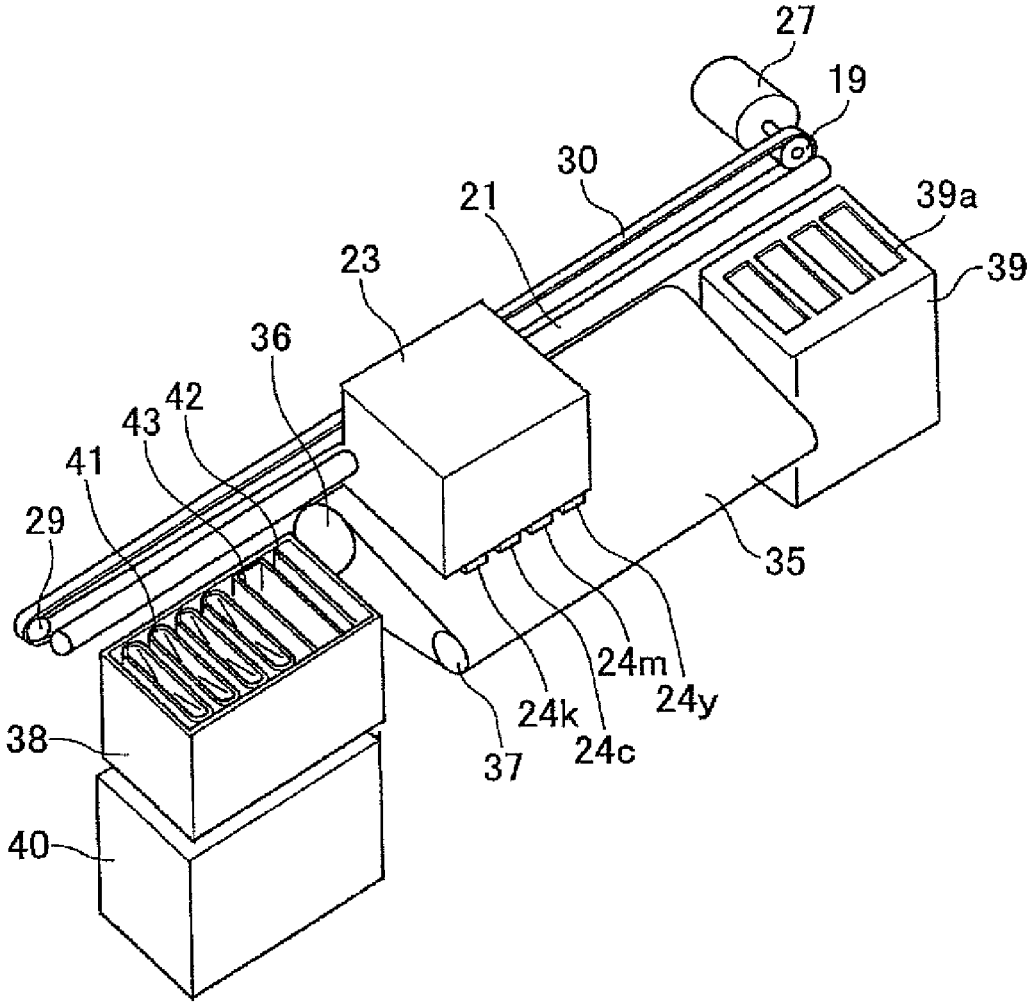
FIG. 3 is a perspective view showing a printing unit of the image forming apparatus of FIG. 1.
Figure 4:
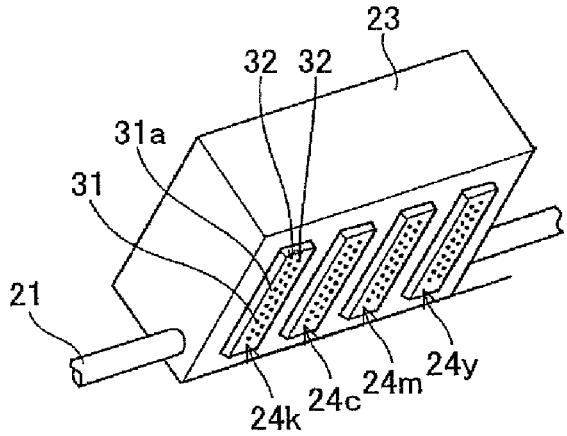
FIG. 4 is a perspective view of the image forming apparatus of FIG. 1 seen from a bottom of a carriage.

As shown in FIG. 3, a carriage 23 of the printing unit 10 here is held by a carriage guide (guide rod) 21 and a guide stay (not shown). The carriage 23 is moved in the horizontal scanning direction by a timing belt 30 set between a driven pulley 29 and a driving pulley 19 which is driven by a horizontal scanning motor 27.

This carriage 23 incorporates a print head 24k formed of a liquid ejection head which ejects black (K) ink, print heads 24*c*, 24*m*, and 24*y* (called "a print head 24" as a collective name or when each color is ignored) each formed of one liquid ejection head to eject cyan (C) ink, magenta (M) ink, and yellow (Y) ink, respectively. A subtank 25 to supply desired ink to each print head 24 is also provided in the carriage 23.

As shown in FIG. 4, each print head 24 has two nozzle arrays 32 in which plural nozzles 31 are arranged in rows to eject droplets. The nozzle arrays 32 are arranged so as to cross the horizontal scanning direction (the direction that the carriage 23 moves) with a surface of the nozzles 31 (nozzle surface 31*a*) facing down.

An ink cartridge 26 is detachably attached to the main body 1 as a main tank to supply ink to the subtank 25 corresponding to each print head 24.

Following are types of print heads as the print head 24, and include; a piezoelectric type print head using piezoelectric elements as a pressure generator (actuator) to pressure ink in an ink channel (pressure generate chamber), in which a vibrating plate as a wall of the ink channel is deformed to change the capacity of the ink channel for ejecting ink droplets; a thermal type print head to heat ink in an ink chamber using a heating element to generate bubbles in the ink, thereby pressuring the ink to be ejected as ink droplets; a static electricity type having the vibrating plate arranged as a wall of the ink chamber and that faces an electrode, in which the vibrating plate is deformed by a static electricity generated between the vibrating plate and the electrode, thereby changing the capacity of the ink chamber to eject ink droplets; and the like.

A loop of a carry belt 35 provided below the carriage 23 carries the paper P by adhering the paper P with static electricity or the like. Set between a driving roller 36 and a driven roller 37, this carry belt 35 rotates to carry the paper P in a direction crossing the horizontal scanning direction. A charged roller 34 charges the carry belt 35 and rotates in accordance with the carry belt 35.

In a nonprinting region on one side of the horizontal scanning direction of the carriage 23, a maintenance and recovery unit (device) 38 is provided to maintain and recover the condition of the print head 24. In a nonprinting region on the other side of the horizontal scanning direction of the carriage 23, a purged ink receiver unit 39 is provided for purging.

The maintenance and recovery unit 38 includes plural caps 41 (an absorbing cap 41*a* and three moisture caps 42*b*) to cover each nozzle surface 31*a* of the print head 24, a wiper blade 42 to wipe the nozzle surface 31*a* of the print head 24, and a purged ink receiver 43. The absorbing cap 41*a* is connected to an absorbing pump 45 as a tube pump which is related to the invention, so that waste ink is discharged from the absorbing pump 45 through a discharge tube 46 into a waste ink container 40 provided under the absorbing cap 41*a*. The purged ink receiver unit 39 has four openings 39*a*.

Figure 5:
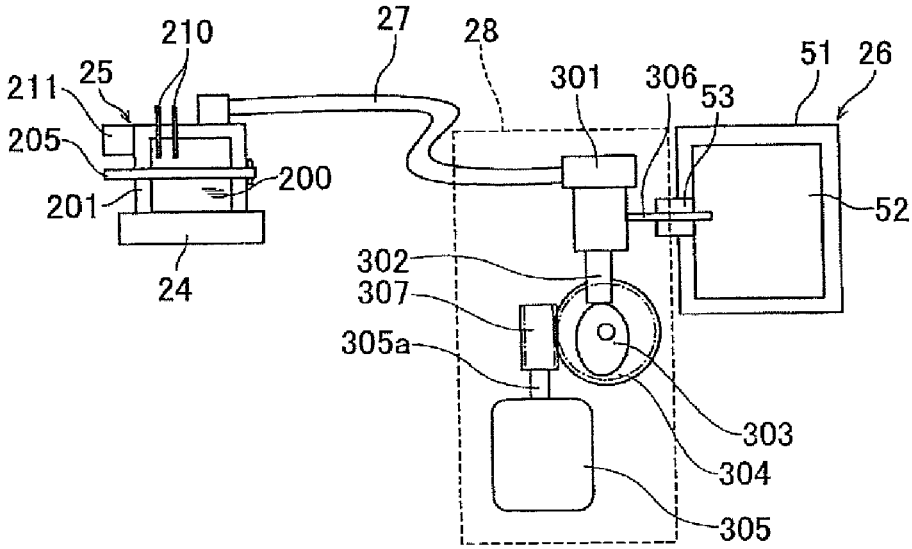
FIG. 5 is a schematic view referred for describing an ink supply system of the image forming apparatus of FIG. 1.

Next, an ink supply system (ink supply device) in the image forming apparatus of the invention is described with reference to a schematic view of FIG. 5.

The ink cartridge 26 as the main tank stores a flexible ink bag 52 containing ink, in a cartridge case 51. This ink bag 52 has an ink supply opening 53 to supply the ink. This ink supply opening 53 has an internal surface formed of an elastic material such as rubber.

The ink is supplied from the ink cartridge 26 through a supply tube 27 to the subtank 25 by driving/stopping a supply pump unit 28. The ink is supplied from the subtank 25 to the print head 24, where the ink is ejected and consumed.

The supply pump unit 28 includes a supply pump 301 as a piston pump, a cam 303 which drives a piston 302 of the piston pump 301 to pump, a gear 304 to rotate the cam 303, a pump driving motor 305 as a pump driver having a motor axis 305*a* attached to a gear 307 that rotates the gear 304, and the like. The supply pump 301 and the ink bag 52 are connected by inserting a hollow needle 306 attached to the supply pump 301 in the elastic member (for example, a rubber plug) of the ink supply opening 53 of the ink bag 52 included in the ink cartridge 26.

Figure 6:
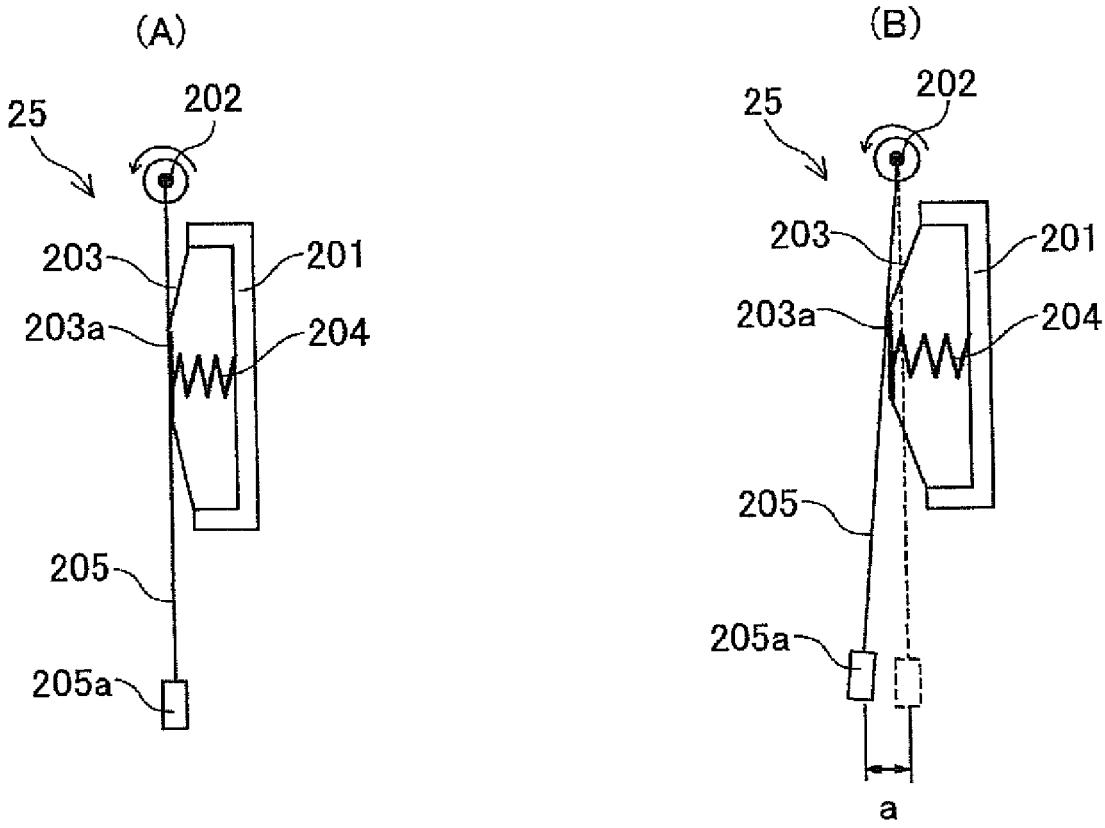
FIGS. 6A and 6B are schematic plan views showing examples of a subtank.

An example of the subtank 25 is described with reference to FIGS. 6A, 6B and 7. FIGS. 6A and 6B show schematic plan views of the subtank 25 and FIG. 7 is a diagram showing an operation to sense the amount of ink left in the subtank 25.

The subtank 25 includes a tank case 201 for holding ink, with one side opened. The open side of the tank case 201 is sealed with a flexible film 203. The film 203 is always biased outwards by a spring 204 as an elastic member provided in the tank case 201. As a result, a negative pressure is generated when the ink in the tank case 201 decreases.

A sensor feeler (negative pressure sensor lever) 205 is displaceably provided outside the tank case 201. The sensor feeler 205 has one end supported by a spindle (fulcrum) 202 so as to be able to fluctuate, and is pressed by a rotation spring (not shown) to contact a top portion 203*a* of the biased film 203. Therefore, when the ink in the subtank 25 increases or decreases, a tip sensor piece 205*a* of the sensor feeler 205 moves in the horizontal scanning direction. Thus, by sensing the position of the sensor feeler 205 at a predetermined position, the negative pressure generated in the subtank 25 or the amount of ink left in the subtank 25 (ink amount in the subtank) can be known.

Figure 7:
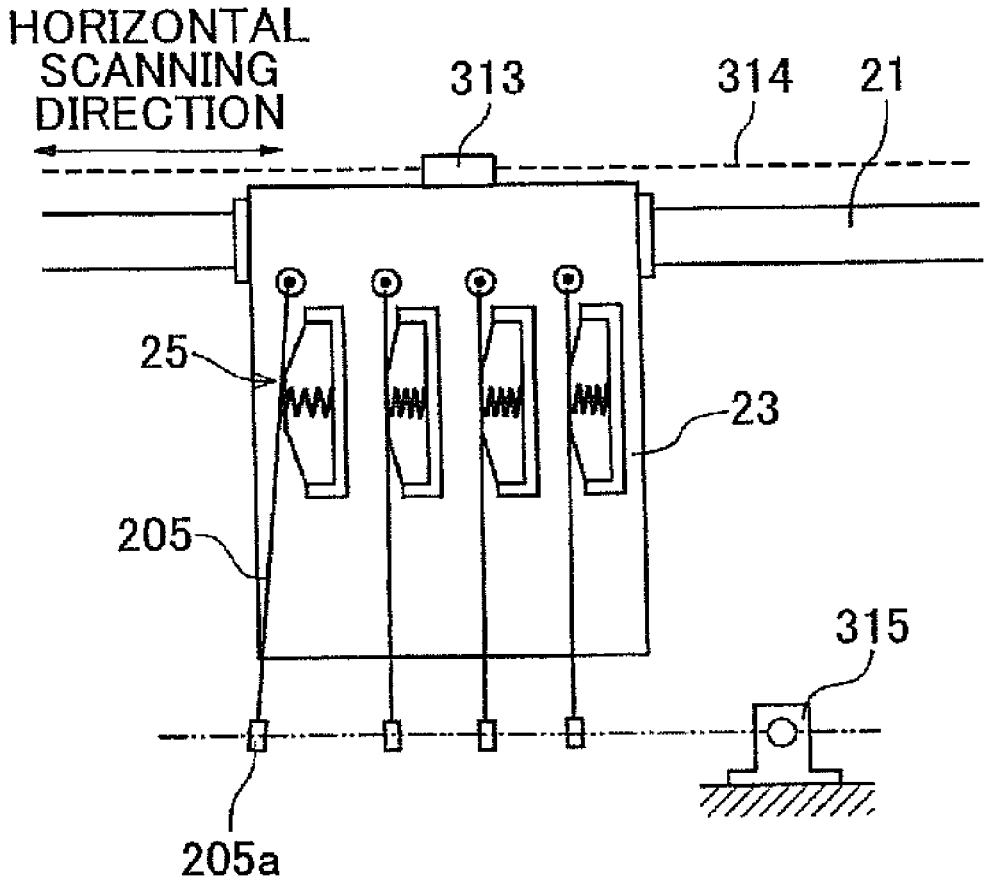
FIG. 7 is a schematic plan view referred for describing detection of an ink amount.

As shown in FIG. 7, for example, a feeler sensor 315 which also senses the full amount of the ink in the subtank is provided as a transmissive optical sensor in the main body. The feeler sensor 315 is set at a position that the tip sensor piece 205*a* of the sensor feeler 205 of each subtank 25 passes through when the carriage 23 moves in the horizontal scanning direction. A position of the carriage 23 in the horizontal scanning direction is detected by an encoder sensor 313 which reads an encoder scale 314 arranged along the horizontal scanning direction of the carriage 23.

The amount of ink left (left ink amount) or full amount of ink in the subtank 25 can be known by a position at which the feeler sensor 315 senses the tip sensor piece 205*a* of the sensor feeler 205 in the horizontal scanning direction. For example, the carriage 23 is stopped at a position that the feeler sensor 315 senses the sensor feeler 205 when the subtank 25 is fully supplied with ink. The sensor feeler 205 displaces in accordance with the amount of ink supplied in the subtank 25. When the feeler sensor 315 senses the sensor feeler 205, it is assumed that the full amount of ink is supplied and the supply pump unit 28 is deactivated.

Furthermore, this subtank 25 has two (or three) sensor electrodes 210 to sense the ink surface in the tank case 201. A predetermined level of the ink amount can be sensed as a resistance value changes depending on the existence of ink between the two sensor electrodes 210.

The subtank 25 has an open valve 211 to expose inside the tank case 201 to the atmosphere. The open valve 211 is opened and closed by an operation pin (not shown) or the like on the carriage 23 side.

Figure 8:
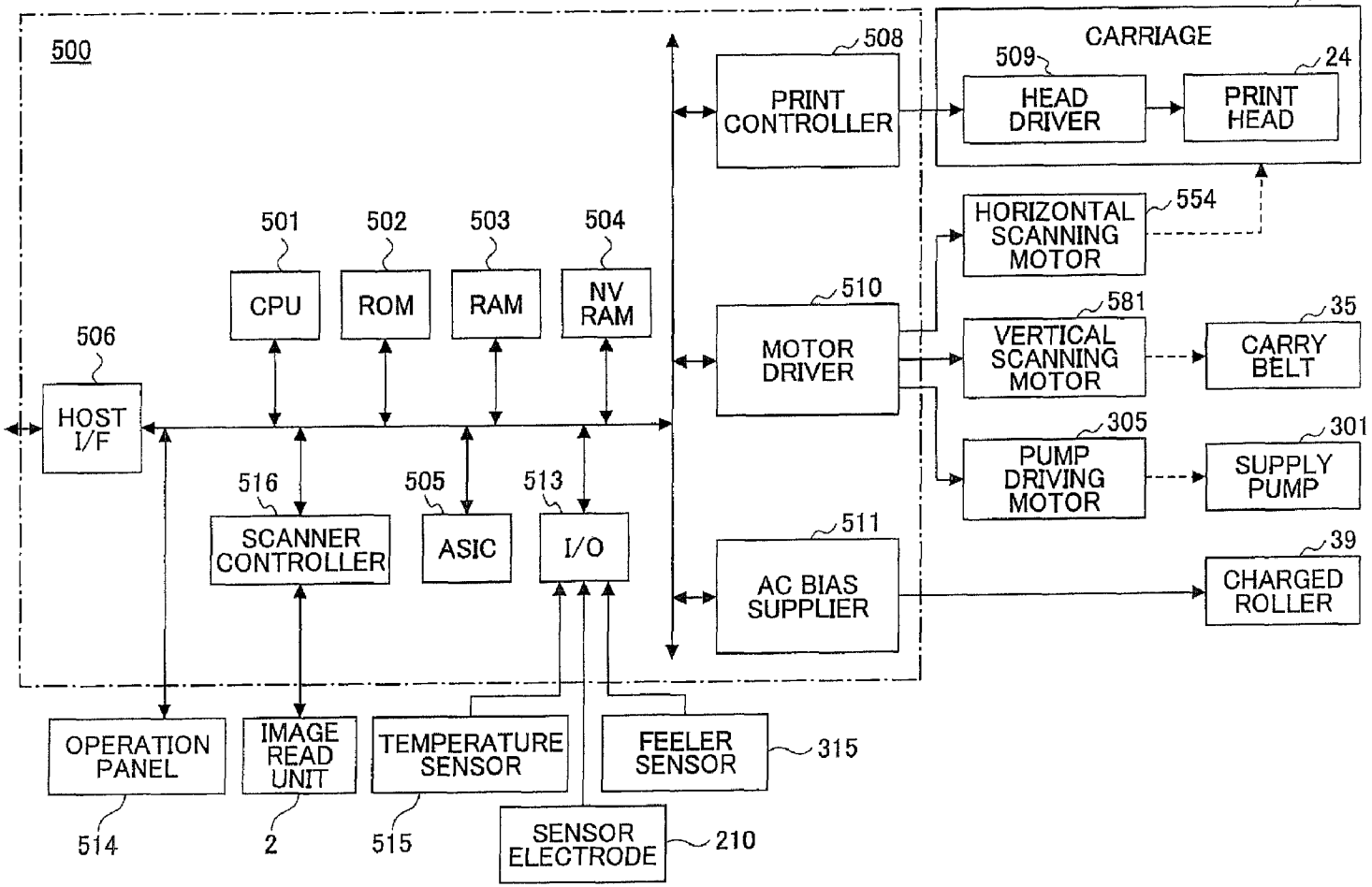
FIG. 8 is an overall block diagram showing a schematic configuration of a controller of the image forming apparatus shown in FIG. 1.

A controller of the image forming apparatus is briefly described with reference to FIG. 8. FIG. 8 is an overall block diagram of the controller.

A controller 500 includes a CPU 501 as a controller which manages overall control of the image forming apparatus of the invention, a ROM 502 which stores a program executed by the CPU 501 and other fixed data, a RAM 503 which temporarily stores image data and the like, a rewritable nonvolatile memory 504 which holds data even after power of the image forming apparatus is shut down, and an ASIC 505 which performs various signal processes, rearrangement, and the like of the image data and a process to input and output signals to control the whole image forming apparatus.

In addition, a print controller 508 including a data transfer unit and a driving signal generator to drive and control the print head 24, a head driver (driver IC) 509 to drive the print head 24 provided on the carriage 23 side, a horizontal scanning motor 554 to move the carriage 23 to scan, a vertical scanning motor 581 to rotate the carry belt 35, a maintenance and recovery motor (not shown) of the maintenance and recovery unit 38, a motor driver 510 to drive a pump driving motor 305 which drives the supply pump 301, an AC bias supplier 511 to supply an AC bias to the charged roller 34 when the maintenance and recovery motor in the maintenance and recovery unit 38 is driven, and the like are provided.

An operation panel 514 to input and display required data is connected to the controller 500.

The controller 500 has a host I/F 506 to send and receive data and signals with a host side such as an information processing apparatus like a personal computer, an image reading apparatus such as a scanner, and an imaging device such as a digital camera through cables or networks.

The CPU 501 in the controller 500 reads out and analyzes print data in a receive buffer included in the host I/F 506, performs a required image process and rearrangement on the data in the ASIC 505, and transfers this data from the print controller 508 to the head driver 509.

The print controller 508 transfers the aforementioned image data as serial data and outputs transfer clock signals, latch signals, control signals and the like required to transfer the image data to the head driver 509. Moreover, the print controller 508 includes a driving signal generator formed of a D/A converter which D/A converts pattern data of driving pulses stored in the ROM, a voltage amplifier, a current amplifier and the like and outputs driving signals formed of one or plural driving pulses to the head driver 509.

Based on the serially inputted image data corresponding to one row of the recording head 24, the head driver 509 drives the print head 24 by selectively applying driving pulses as driving signals outputted from the print controller 508 to driving elements (for example, piezoelectric elements) which generate energy to eject droplets from the print head 24. At this time, droplets of different sizes, for example, large droplets, medium droplets, small droplets, and the like can be selectively ejected by selecting the driving pulses of the driving signals.

An I/O unit 513 obtains data from various sensors of the image forming apparatus, extracts the data required for various controls, and controls the print controller 508, the motor controller 510, and the AC bias supplier 511 based on the extracted data. The I/O unit 513 can process data of various sensors such as an optical sensor to sense the position of the paper, a temperature sensor 515 such as a thermistor to monitor the temperature inside the apparatus, a sensor to monitor a charged voltage, an interlock switch to sense the opening and closing of a cover, the aforementioned feeler sensor 315 to sense the sensor feeler 205 of the subtank 25 or the like, the sensor electrode 210 of the subtank 25, and the like.

In addition, a scanner controller 516 to control the image read unit 2 is provided.

Figure 9:
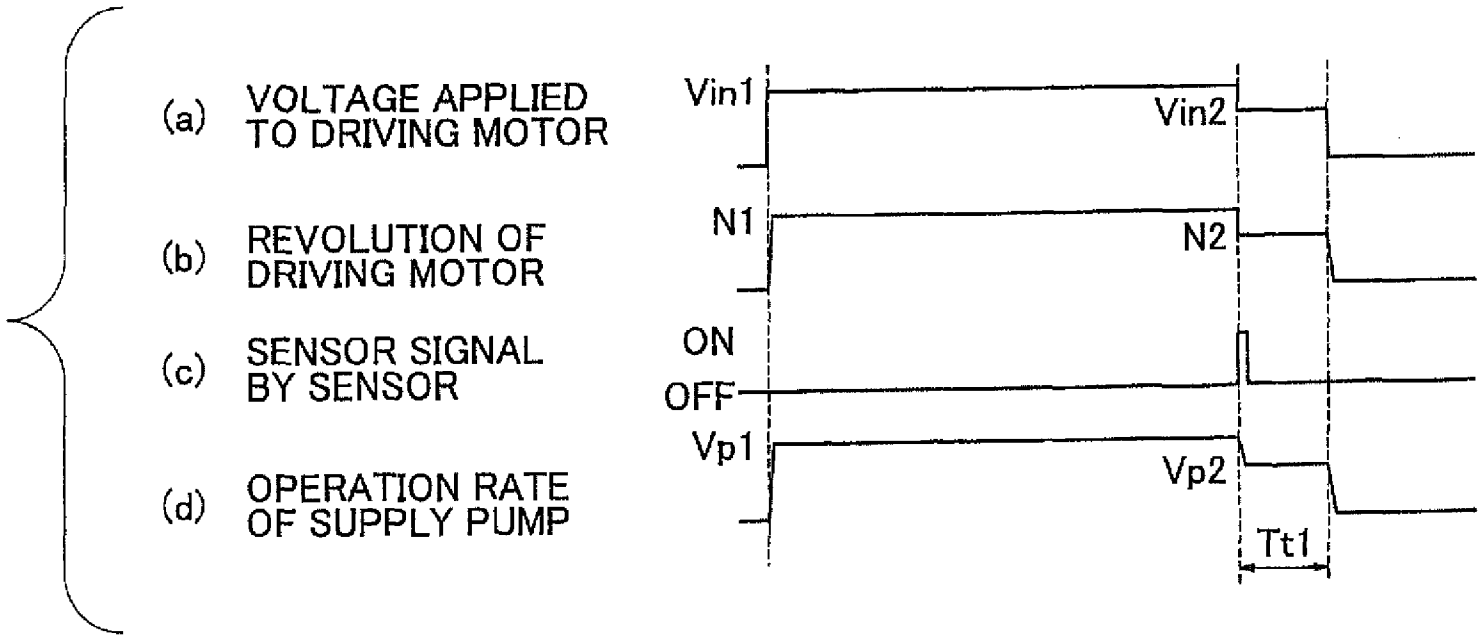
FIG. 9 is a timing chart referred for describing the first embodiment of the invention.

Next, a first embodiment of the invention is described with reference to a timing chart shown in FIG. 9.

When ink supply from the ink cartridge 26 to the subtank 25 is required, the controller applies a driving voltage Vin1 to the pump driving motor 305 as shown in FIG. 9*a*. As a result, the pump driving motor 305 starts rotation at a revolution of N1 as shown in FIG. 9*b*. Moreover, the supply pump 301 starts an operation at an operation rate of Vp1, thereby the ink is replenished from the ink cartridge 26 to the subtank 25.

When the ink amount in the subtank 25 increases, the negative pressure sensor lever (sensor feeler 205) displaces. When the ink amount reaches a predetermined level, the feeler sensor 315 senses the sensor feeler 205, thereby a sensor signal is outputted (becomes ON) from the feeler sensor 315 serving as the amount sensor as shown in FIG. 9*c*.

The controller changes the driving voltage applied to the pump driving motor 305 from the voltage Vin1 to a voltage Vin2 (Vin2<Vin1) when the sensor signal is outputted by the feeler sensor 315 (amount sensor). Thus, the revolution of the pump driving motor 305 decreases from N1 to N2 (N2<N1) and the operation rate of the supply pump 301 also decreases from Vp1 to Vp2 (Vp2<Vp1). During predetermined allowable time Tt1, the pump driving motor 305 is driven at a revolution of N2 and the supply pump 301 is driven at the operation rate of Vp2. When the allowable time Tt1 has passed, the driving voltage is not applied to the pump driving motor 305 to stop the supply pump 301.

When the voltage (driving voltage) applied to the pump driving motor 305 is decreased, that is, when the operation rate of the supply pump 301 is decreased, it takes less time until the supply pump 301 actually stops after the pump driving motor 305 is stopped. As a result, the amount of ink supply can be stabilized with less variation, thereby the desired amount of ink can be supplied.

The feeler sensor 315 is set to sense the sensor feeler 205 (the feeler sensor 315 is turned ON) at an ink supply level lower (earlier) than the full amount level by an ink amount sent when the supply pump 301 operates at the operation rate of Vp2 for the allowable time of Tt1.

In this manner, when supplying ink from the main tank to the subtank by driving the supply pump, the pump driver is controlled so that a rate of the ink supply is decreased in response to the sensor signal outputted by the amount sensor when the ink amount in the subtank reaches the predetermined level, and the ink supply by the supply pump is stopped when predetermined time (the allowable time Tt1) has passed after the ink amount reaches the predetermined level. As a result, time (time for stop) required for the supply pump to stop can be shortened. Thus, the amount of ink supply can be stabilized with less variation, without extending the time required to supply ink from the main tank to the subtank.

Figure 10:
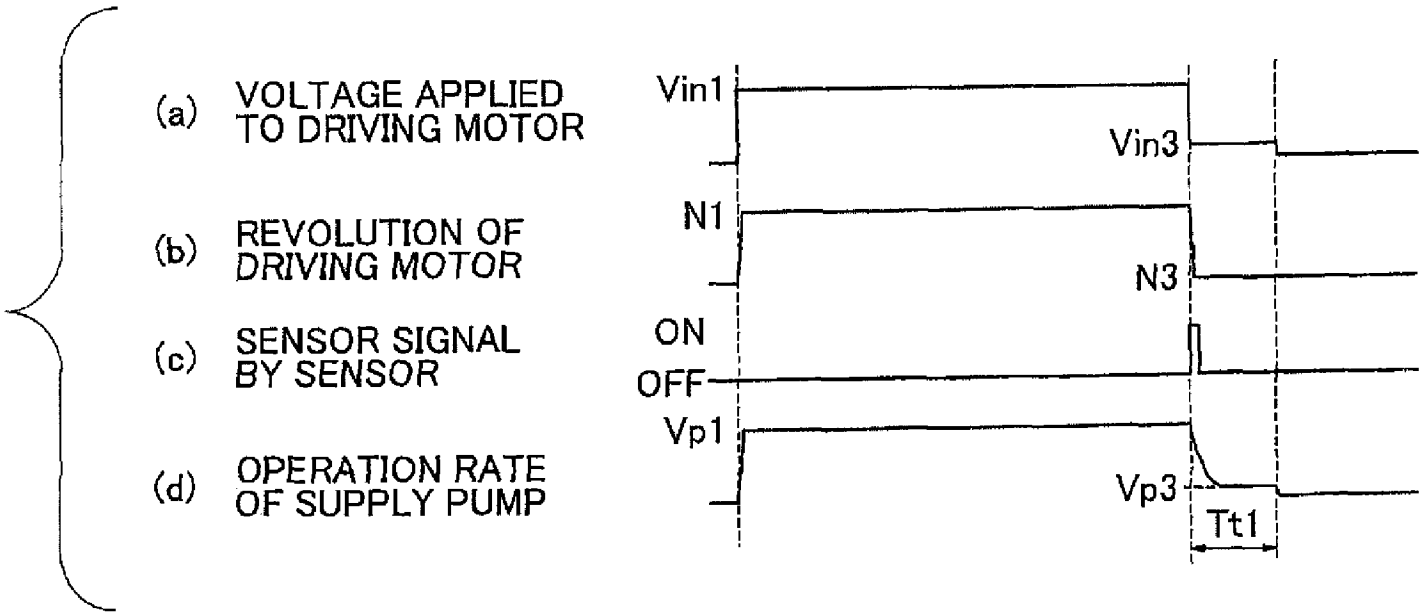
FIG. 10 is a timing chart referred for describing the second embodiment of the invention.

A second embodiment of the invention is described with reference to the timing chart shown in FIG. 10.

When ink supply from the ink cartridge 26 to the subtank 25 is required, the controller applies the driving voltage Vin1 to the pump driving motor 305 as shown in FIG. 10*a*. As a result, the pump driving motor 305 starts rotation at the revolution of N1 as shown in FIG. 10*b*. Moreover, the supply pump 301 starts operation at the operation rate of Vp1, thereby ink is supplied from the ink cartridge 26 to the subtank 25.

When the ink amount in the subtank 25 increases, the negative sensor lever (sensor feeler 205) displaces. When the sensor feeler 205 reaches the predetermined level, the feeler sensor 315 senses the sensor feeler 205 and outputs a sensor signal as shown in FIG. 10*c*.

The controller decreases the driving voltage applied to the pump driving motor 305 from Vin1 to Vin3 (Vin3<Vin2<Vin1) when the sensor signal is outputted by the feeler sensor 315 (amount sensor). Accordingly, the revolution of the pump driving motor 305 decreases from N1 to N3 (N3<N2<N1) and the operation rate of the supply pump 301 also decreases from Vp1 to Vp3 (Vp3<Vp2<Vp1). During the predetermined allowable time of Tt1, the pump driving motor 305 is driven at the revolution of N3 and the supply pump 301 is driven at the decreased operation rate of Vp3. When the allowable time Tt1 has passed, the driving voltage is not applied to the pump driving motor 305 to stop the supply pump 301.

Figure 11:
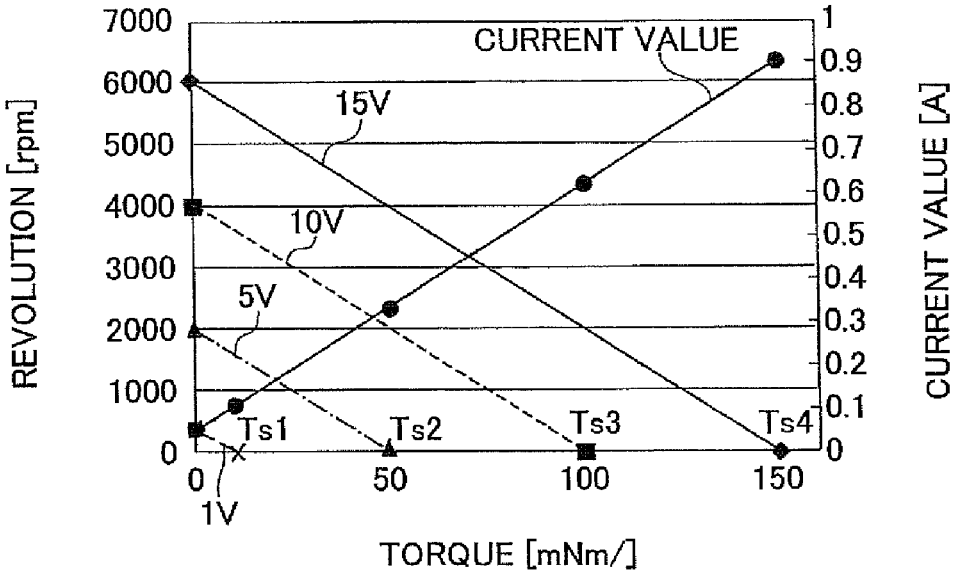
FIG. 11 is a diagram showing an example of a relationship between a torque and a revolution of a motor and a current value, referred for describing a stall torque.

By setting the driving voltage Vin3 so that the stall torque of the pump driving motor 305 becomes smaller than a driving load of the supply pump 301, the revolution N3 of the pump driving motor 305 and the operation rate Vp3 of the supply pump 301 become almost zero. By decreasing the applied voltage rapidly from Vin1 to Vin3, an electromotive current flows in the pump driving motor 305. Accordingly, a braking effect is generated and the ink supply can be stopped during the allowable time Tt1. The "stall torque" is torque generated when the motor stops rotation by an increased load. For example, the torque Ts1, Ts2, Ts3, and Ts4 are stall torque for the applied voltages 1 V, 5 V, 10 V, and 15 V shown in FIG. 11, respectively. FIG. 11 is a diagram showing an example of relationships between the torque and the revolution, and between the torque and a current value.

Figure 12:
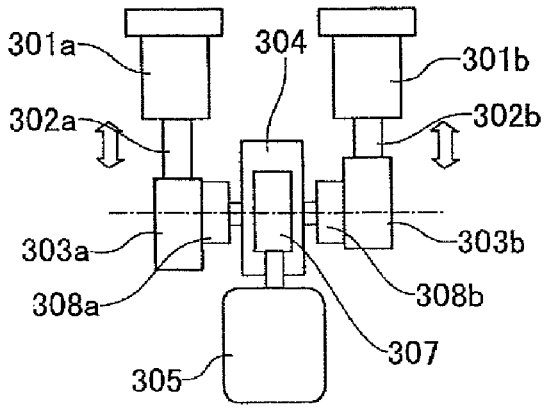
FIG. 12 is a schematic view showing a supply pump unit of the third embodiment of the invention.

Subsequently, a third embodiment of the invention is described with reference to FIG. 12. FIG. 12 is a schematic view showing a pump unit of this embodiment.

In this embodiment, the ink cartridges 26 supply the subtanks 25 of each color with ink of corresponding colors. The pump driving motor 305 as a pump driver drives supply pumps 301*a* and 301*b* which supply ink to the subtanks 25 from two of the ink cartridges 26.

Cams 303*a* and 303*b* drive the supply pumps 301*a* and 301*b* and pistons 302*a* and 302*b* of the supply pumps 301 and 301*b* to pump, respectively. One-way clutches 308*a* and 308*b* rotate the cams 303*a* and 303*b* respectively in only one direction each. A wheel gear 304 rotates the cams 303*a* and 303*b*. A warm gear 307 rotates the wheel gear 304. The warm gear 307 is attached to a motor axis of the pump driving motor 305 as a driving source of the pump driver.

The one-way clutches 308*a* and 308*b* operate so that only the cam 303*a* rotates when the pump driving motor 305 rotates in a positive rotation direction and so that only the cam 303*b* rotates when the pump driving motor 305 rotates in a negative rotation direction.

When the pump driving motor 305 drives the two supply pumps 301*a* and 301*b*, it is impossible to shorten the time required to stop the pump driving motor 305 by applying a reverse brake to the pump driving motor 305 by supplying a reverse current. By employing the first and second embodiments, the time (time for stop) required to for the supply pump 301 to stop can be shortened. Thus, the amount of ink supply can be stabilized with less variation, without extending the time required to supply ink from the main tank to the subtank.

Figure 13:
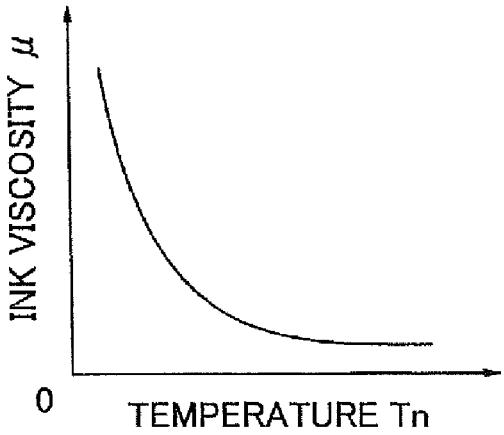
FIG. 13 is a diagram showing an example of a relationship between a temperature and an ink viscosity in the fourth embodiment of the invention.
Figure 14:
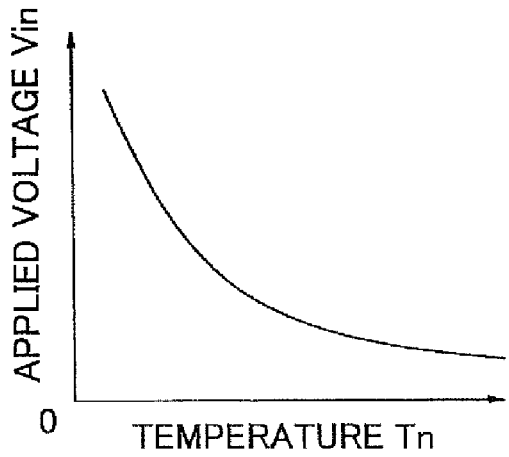
FIG. 14 is a diagram showing an example of a relationship between a temperature and a voltage applied to a pump driving motor in the fourth embodiment of the invention.

Next, a fourth embodiment of the invention is described with reference to FIGS. 13 and 14. FIG. 13 is a diagram showing a relationship between the temperature and the ink viscosity characteristics. FIG. 14 is a diagram showing an example of a relationship between the temperature and the applied voltage.

As shown in FIG. 13, the ink viscosity increases at a low temperature. When the ink viscosity μ increases, the ink supply rate is relatively decreased with the same applied voltage Vin.

In view of this, the applied voltage Vin is set according to the temperature Tn as shown in FIG. 14 so that the desired ink supply rate can be achieved. That is, by increasing the voltage Vin applied to the pump driving motor 305 as the temperature Tn relatively falls, the ink supply rate decreased in accordance with the increase of the ink viscosity can be compensated.

Figure 15:
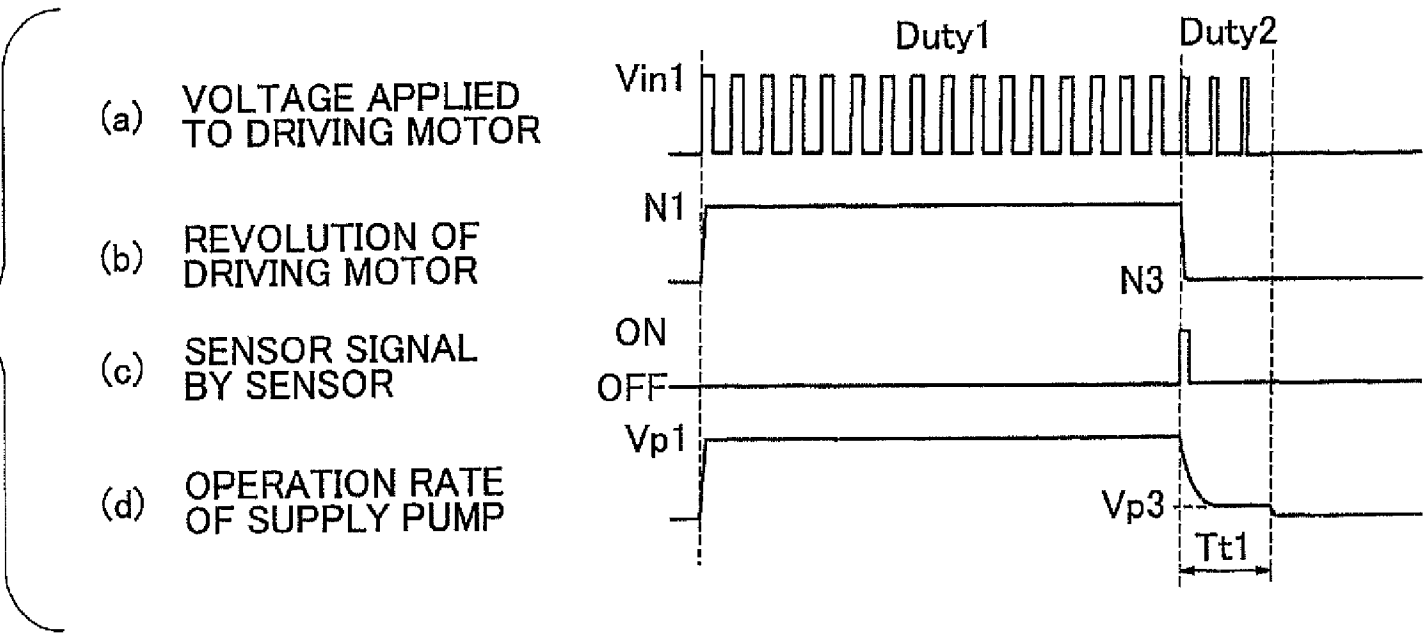
FIG. 15 is a timing chart referred for describing the fifth embodiment of the invention.

A fifth embodiment of the invention is described with reference to a timing chart of FIG. 15.

In this embodiment, a pulsed voltage is applied to the pump driving motor 305. A driving voltage Vin1 is applied with a duty ratio (Duty) of 1 until the sensor signal is outputted by the amount sensor. When the amount sensor outputs the sensor signal, the duty ratio is changed from Duty1 to a duty ratio (Duty) 2 (Duty1>Duty2). In this manner, the operation rate of the supply pump 301 is decreased and the supply pump 301 is stopped when the allowable time Tt1 has passed.

Figure 16:
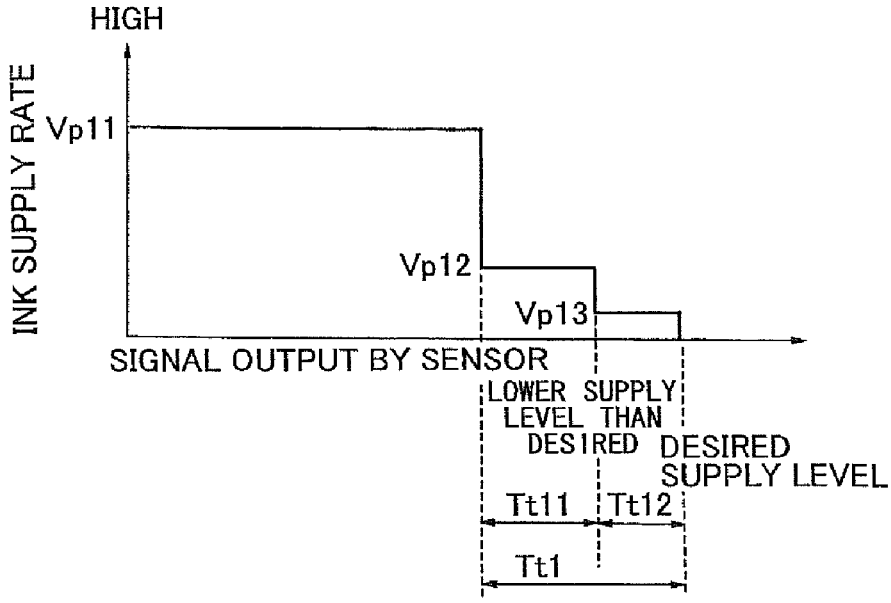
FIG. 16 is a diagram showing a staged decrease of an ink supply rate referred for describing the sixth embodiment of the invention.

A sixth embodiment of the invention is described with reference to FIG. 16. FIG. 16 is a diagram showing a staged decrease of the ink supply rate, which is described in this embodiment.

In this embodiment, the pump driving motor 305 is driven so that the supply pump 301 supplies ink at the ink supply rate of Vp11 until the amount sensor outputs a sensor signal (until the feeler sensor 315 senses the negative sensor lever 205). When the amount sensor outputs the sensor signal, the pump driving motor 305 is driven so that the ink supply rate of the supply pump 301 is decreased to Vp12 (Vp12<Vp11). Further, when predetermined time Tt11 has passed after the amount sensor outputs a sensor signal, the pump driving motor 305 is driven so that the ink supply rate of the supply pump 301 becomes Vp13 (Vp13<Vp12). Furthermore, the pump driving motor 305 is controlled to stop the supply pump 301 when the allowable time Tt1 has passed, which is when the predetermined time Tt11 and the predetermined time Tt12 have passed.

In this manner, by decreasing the ink supply rate of the supply pump 301 in a staged manner, the supply pump 301 can be stopped more precisely when the ink amount reaches the desired level.

Figure 17:
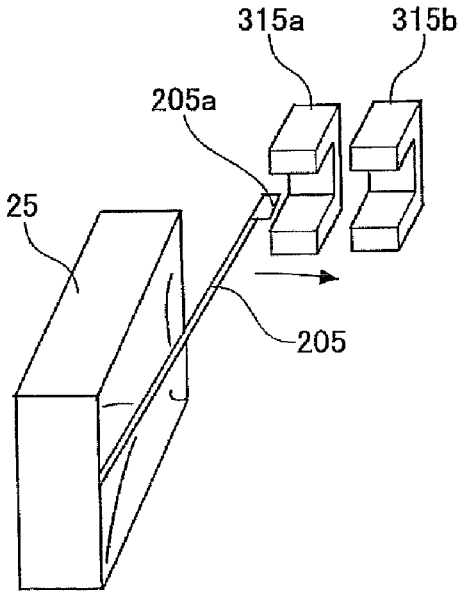
FIG. 17 is a schematic perspective view showing a sensor unit referred for describing the seventh embodiment of the invention.
Figure 18:
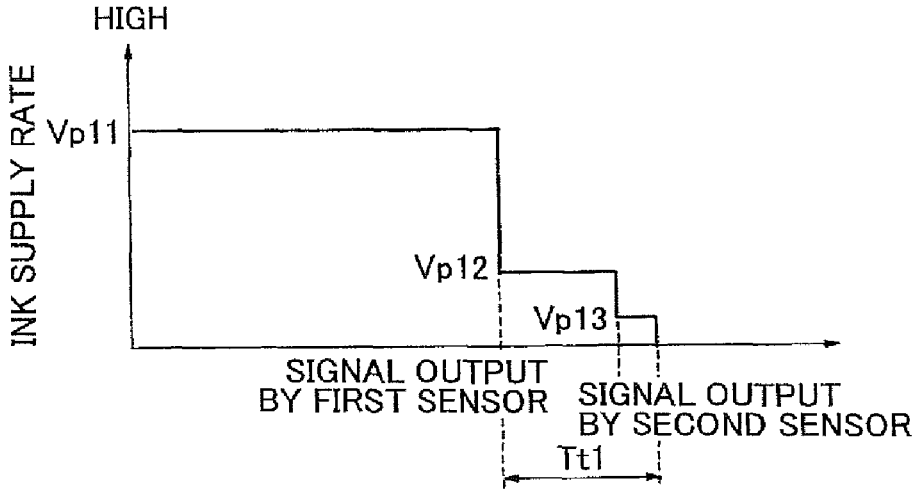
FIG. 18 is a diagram showing a staged decrease of an ink supply rate referred for describing the seventh embodiment of the invention.

A seventh embodiment of the invention is described with reference to FIGS. 17 and 18. FIG. 17 is a view showing a two-staged sensing of the negative pressure sensor lever (sensor feeler) in this embodiment. FIG. 18 is a diagram showing changes of the ink supply rate.

As shown in FIG. 17, the sensor feeler 205 is displaced in a direction of an arrow by the ink supply to the subtank 25. A feeler sensor 315*a* senses the sensor feeler 205 at a first position and a feeler sensor 315*b* senses the sensor feeler 205 at a second position closer to the full amount level than the first position.

As shown in FIG. 18, the pump driving motor 205 is driven so that the supply pump 301 supplies ink at the ink supply rate of Vp11 until the first feeler sensor 315*a* (first sensor) outputs a sensor signal. When the first feeler sensor 315*a* outputs a sensor signal, the pump driving motor 305 is driven so that the supply pump 301 supplies ink at the decreased ink supply rate of Vp12 (Vp12<Vp11). Moreover, the pump driving motor 305 is driven so that the ink supply rate of the supply pump 301 becomes Vp13 (Vp13<Vp12) after predetermined time has passed after the second feeler sensor 315*b* (second sensor) outputs a sensor signal. The pump driving motor 305 is controlled so that the supply pump 301 is stopped when the allowable time Tt1 has passed after the first sensor outputs the sensor signal.

Figure 19:
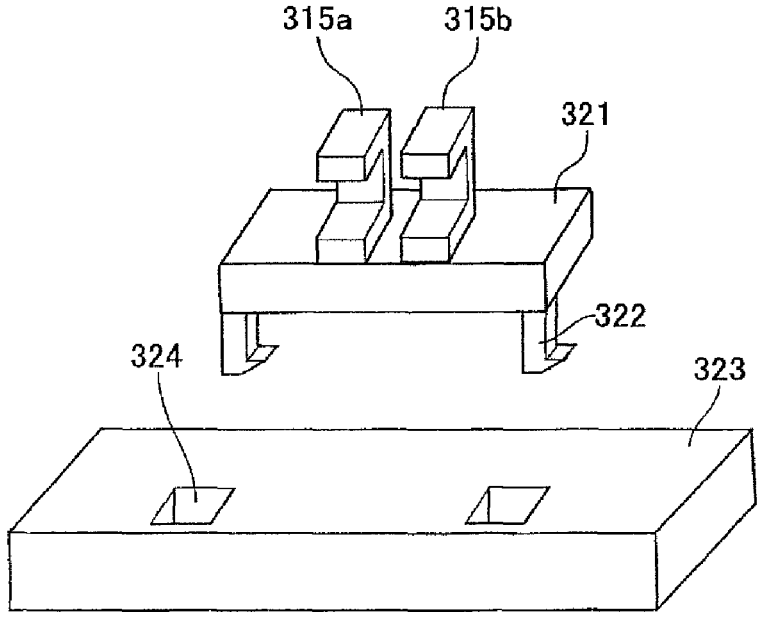
FIG. 19 is a perspective view showing an example of a sensor unit structure referred for describing the seventh embodiment of the invention.

In this embodiment, the two feeler sensors 315*a* and 315*b* are attached as a unit to a base member 321 as shown in FIG. 19. A pawl unit 322 attached to the base member 321 is detachably engaged in a hole 324 formed in a holding member 323 in the main body. The unit structure makes assembly and replacement easier.

Figure 20:
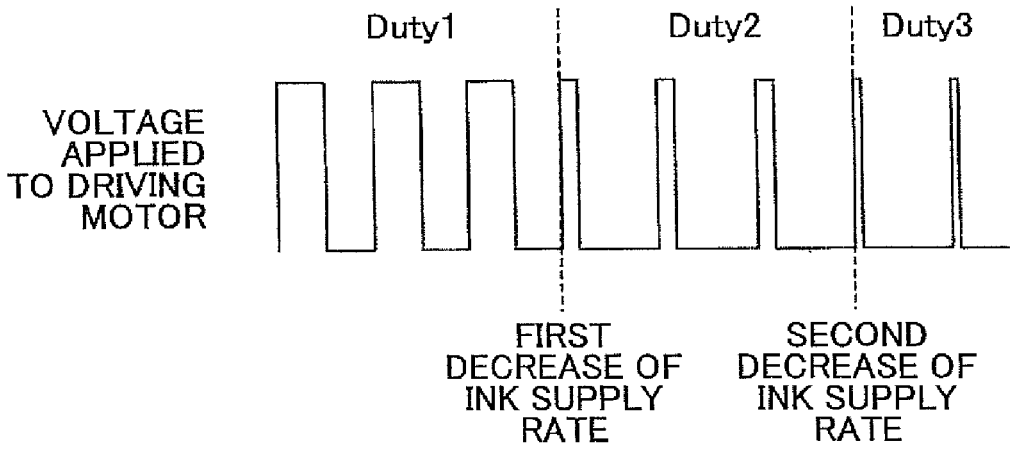
FIG. 20 is a diagram referred for describing a voltage applied to a pump driving motor referred for describing the eighth embodiment of the invention.

An eighth embodiment of the invention is described with reference to FIG. 20.

In this embodiment, similarly to the fifth embodiment, a pulsed voltage is applied to the pump driving motor 305. The duty ratio is changed (Duty1>Duty2>Duty3) to decrease the ink supply rate in a staged manner as described in the sixth and seventh embodiments.

Figure 21:
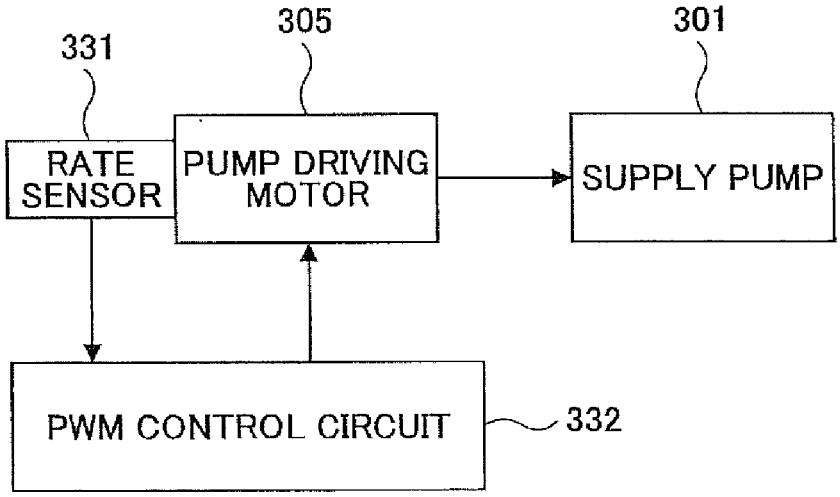
FIG. 21 is a block diagram showing the ninth embodiment of the invention.

A ninth embodiment of the invention is described with reference to a block diagram of FIG. 21.

In this embodiment, the pump driving motor 305 has a rate sensor 331 such as a rotary encoder. In response to a sensor signal of the rate sensor 331, a PWM control circuit 332 controls the pump driving motor 305.

When a piston pump is used as the supply pump 301 as described above, a piston cycle varies depending on the load of the pump driving motor 305. Therefore, with a constant duty ratio (Duty), the revolution of the pump driving motor 305 varies, which makes it difficult to keep the ink supply rate constant. In view of this, the revolution of the pump driving motor 305 can be kept constant by using the rate sensor to control the pump driving motor 305 by the PWM control. As a result, the ink supply amount can be stabilized.

Figure 22:
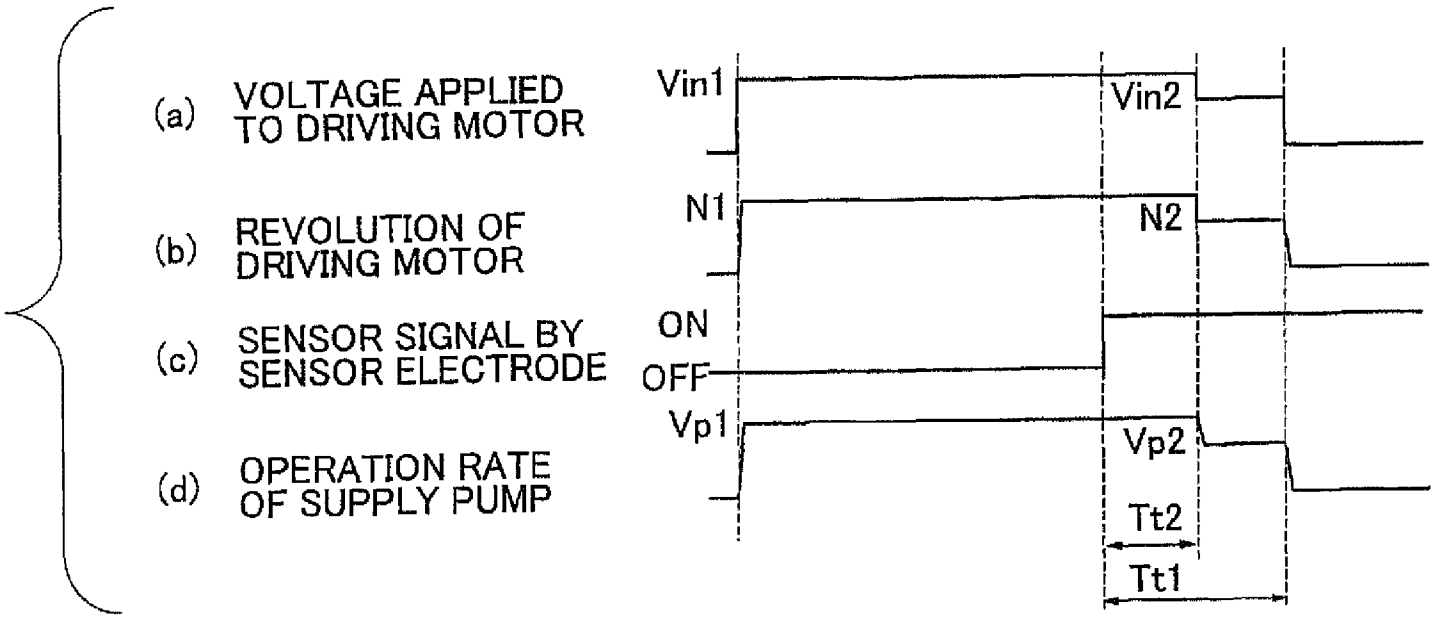
FIG. 22 is a timing chart referred for describing the tenth embodiment of the invention.
Figure 23:
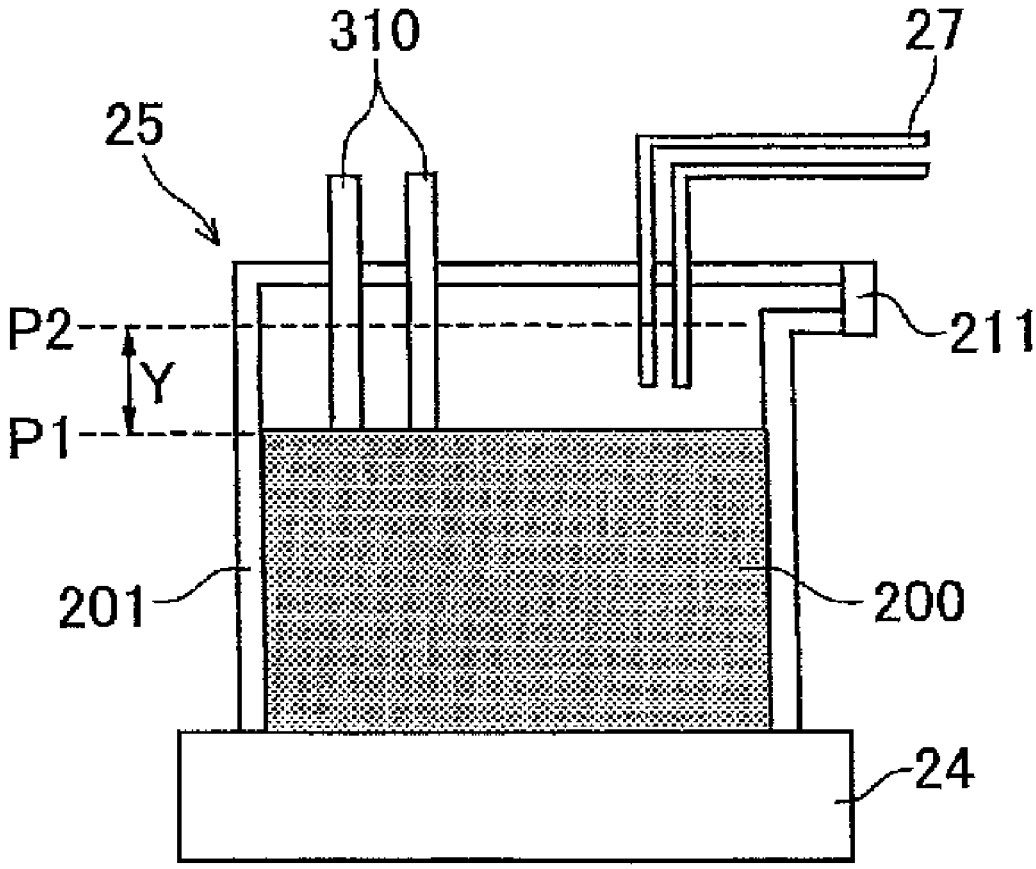
FIG. 23 is a schematic view of a subtank referred for describing a timing to change an ink supply rate, referred for describing the tenth embodiment of the invention.

The ninth embodiment of the invention is described with reference to FIGS. 22 and 23. FIG. 22 shows a timing chart described in this embodiment. FIG. 23 is a view showing a subtank referred for describing a timing to change the ink supply rate.

In this embodiment, sensor electrodes 310 are used as amount sensors to sense the ink surface in the subtank 25. As shown in FIG. 23, a level at which an ink surface of ink 200 contacts the sensor electrodes 310 is P1 and a full amount level of the ink 200 is P2 as shown in FIG. 23. When the ink surface reaches the level P1, the ink supply rate is decreased.

As shown in FIG. 22, when the ink supply is required from the ink cartridge 26 to the subtank 25, the controller applies a driving voltage Vin1 to drive the pump driving motor 305 as shown in FIG. 22*a*. As a result, the pump driving motor 305 starts rotating at a revolution of N1 as shown in FIG. 22*b*. Moreover, the supply pump 301 starts an operation at an operation rate of Vp1, thereby the ink is supplied from the cartridge 26 to the subtank 25.

When the ink amount in the subtank 25 increases and the ink surface contacts the sensor electrodes 310 (the ink surface rises to the level P1), that is when the ink amount reaches the predetermined amount, a resistance between the sensor electrodes 310 changes. As shown in FIG. 22*c*, a sensor signal is outputted by the sensor electrodes 310 serving as the amount sensors.

The controller decreases the voltage Vin1 applied to the pump driving motor 305 to Vin2 (Vin2<Vin1) when first predetermined time Tt2 has passed after the sensor electrodes 310 output the sensor signal. Accordingly, the revolution of the pump driving motor 305 also decreases from N1 to N2 (N2<N1) and the operation rate of the supply pump 301 decreases from Vp1 to Vp2 (Vp2<Vp1). During predetermined time (Tt1-Tt2), the pump driving motor 305 is driven at the revolution of N2 and the supply pump 301 is driven at the decreased operation rate of Vp2. When the allowable time Tt1 has passed after the ink amount in the subtank 25 reaches the predetermined level, a driving voltage is not applied to the pump driving motor 305 to stop the supply pump 301.

In this manner, when driving the supply pump by the pump driver to supply ink from the main tank to the subtank, the ink supply rate of the supply pump is decreased when the predetermined time has passed after the ink amount of the subtank reaches the predetermined level and the sensor signal is outputted by the amount sensor. Then, the pump driver is controlled so that the supply pump stops supplying ink when the predetermined time has passed after the sensor signal is outputted by the amount sensor. In this manner, the amount of ink supply can be stabilized with less variation, without extending the time required for the main tank to supply ink to the subtank.

When the ink supply rate is decreased in response to the sensor signal outputted by the sensor electrodes 310 as described above, the ink supply rate is not decreased during the predetermined time Tt2. However, the predetermined time Tt2 may be zero when the ink surface level P1 sensed by the sensor electrodes 310 is close to the full amount level P2. In this case, an operation to decrease the ink supply rate, which is similar to the first embodiment or the like is performed.

Figure 24:
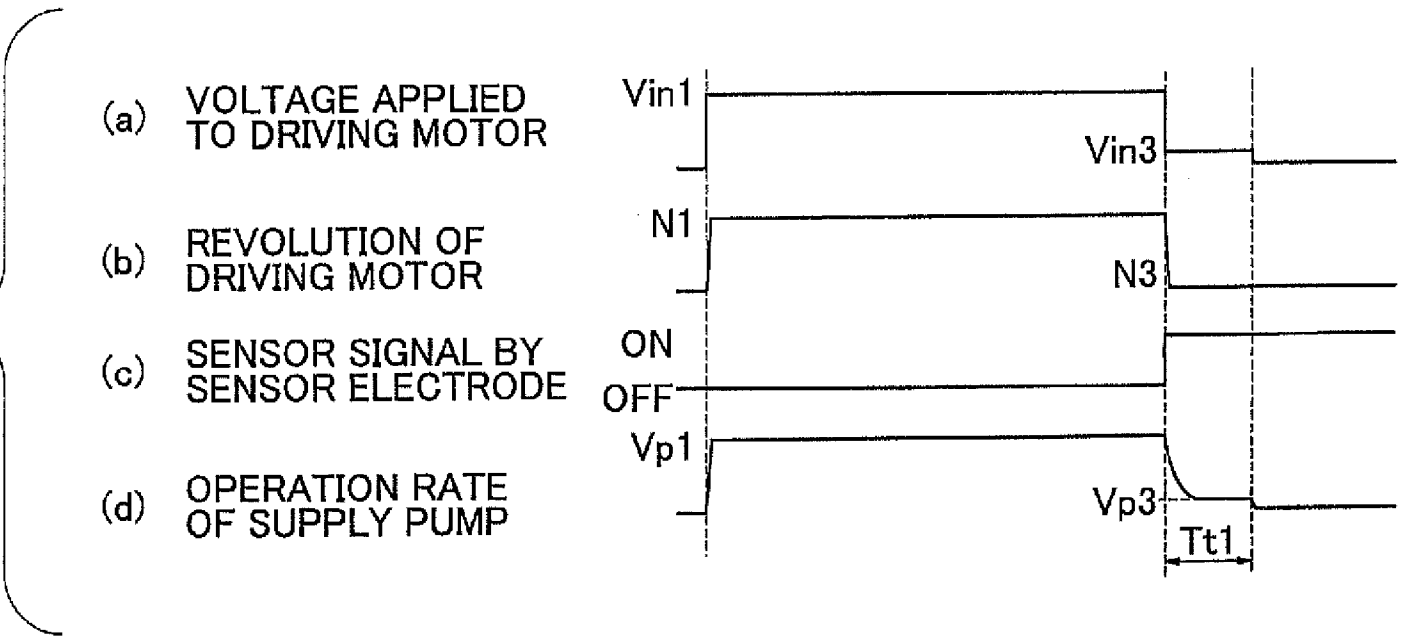
FIG. 24 is a timing chart referred for describing the eleventh embodiment of the invention.

Next, a tenth embodiment of the invention is described with reference to a timing chart shown in FIG. 24.

Instead of using the feeler sensor 315 used in the second embodiment, the sensor electrodes 310 are used as amount sensors in this embodiment similarly to the ninth embodiment. The predetermined time Tt2 of the ninth embodiment is zero in this embodiment, of which description is omitted here.

Figure 25:
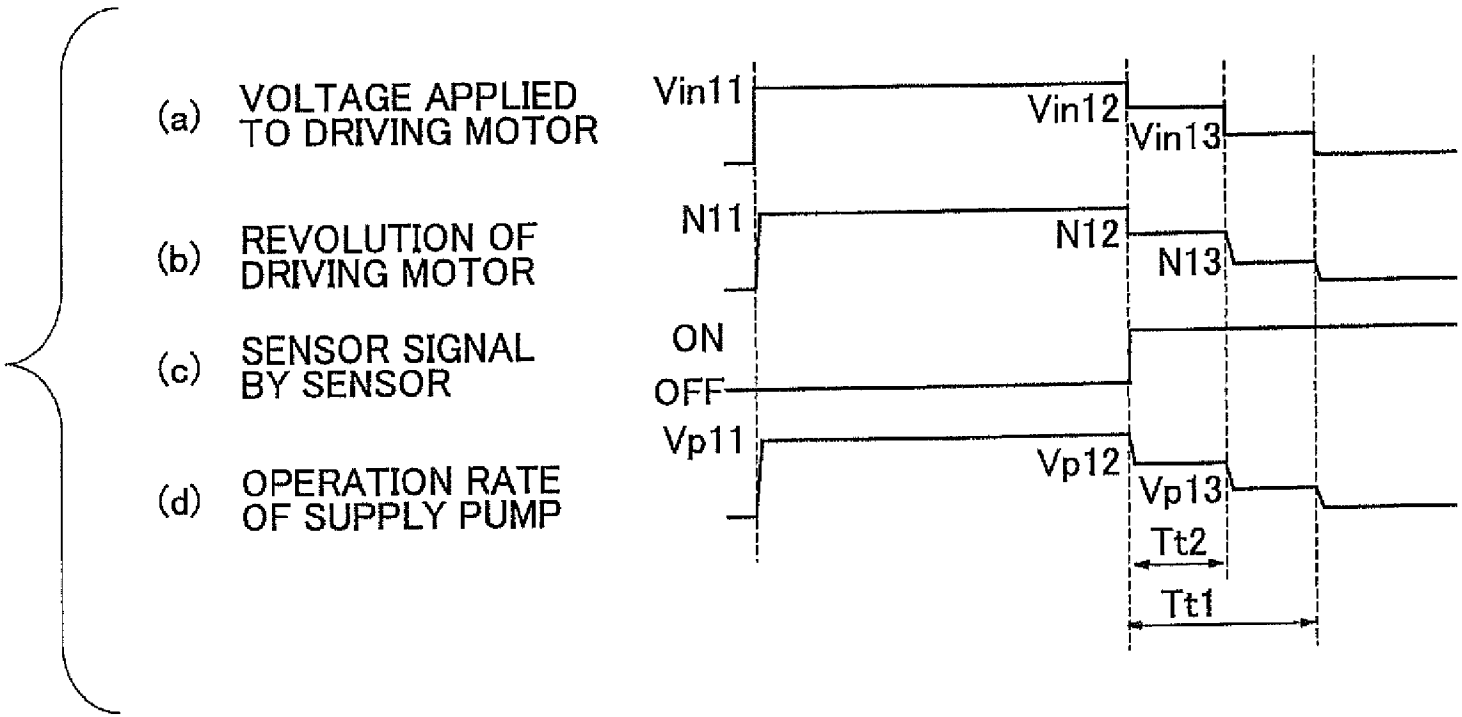
FIG. 25 is a timing chart referred for describing the twelfth embodiment of the invention.
Figure 26:
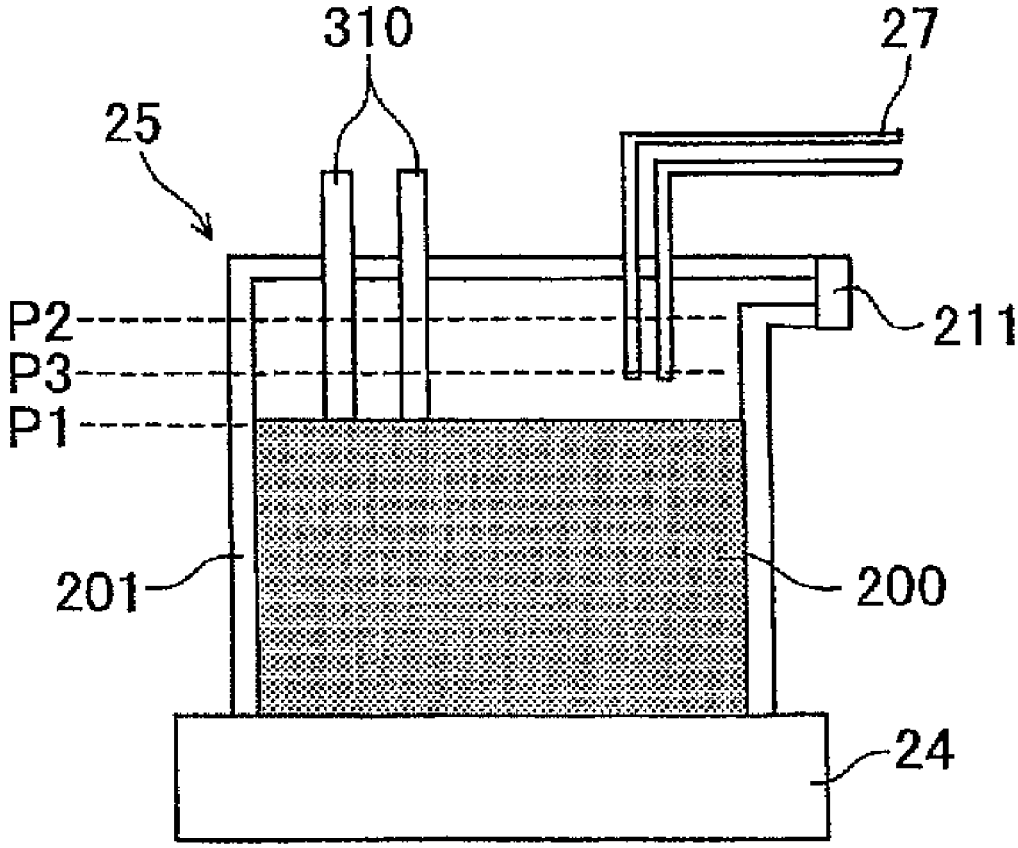
FIG. 26 is a schematic view of a subtank referred for describing a timing to change an ink supply rate, referred for describing the twelfth embodiment of the invention.
Figure 27:
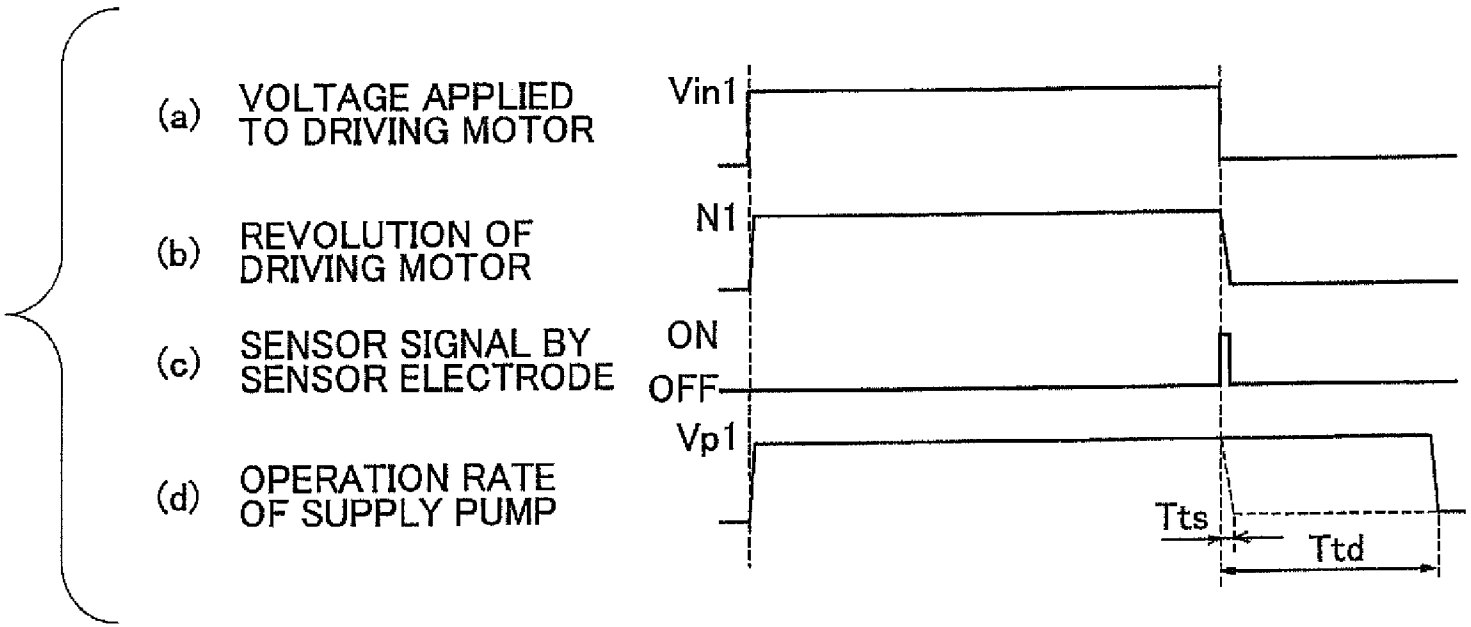
FIG. 27 is a timing chart referred for describing a comparison example 1.
Figure 28:
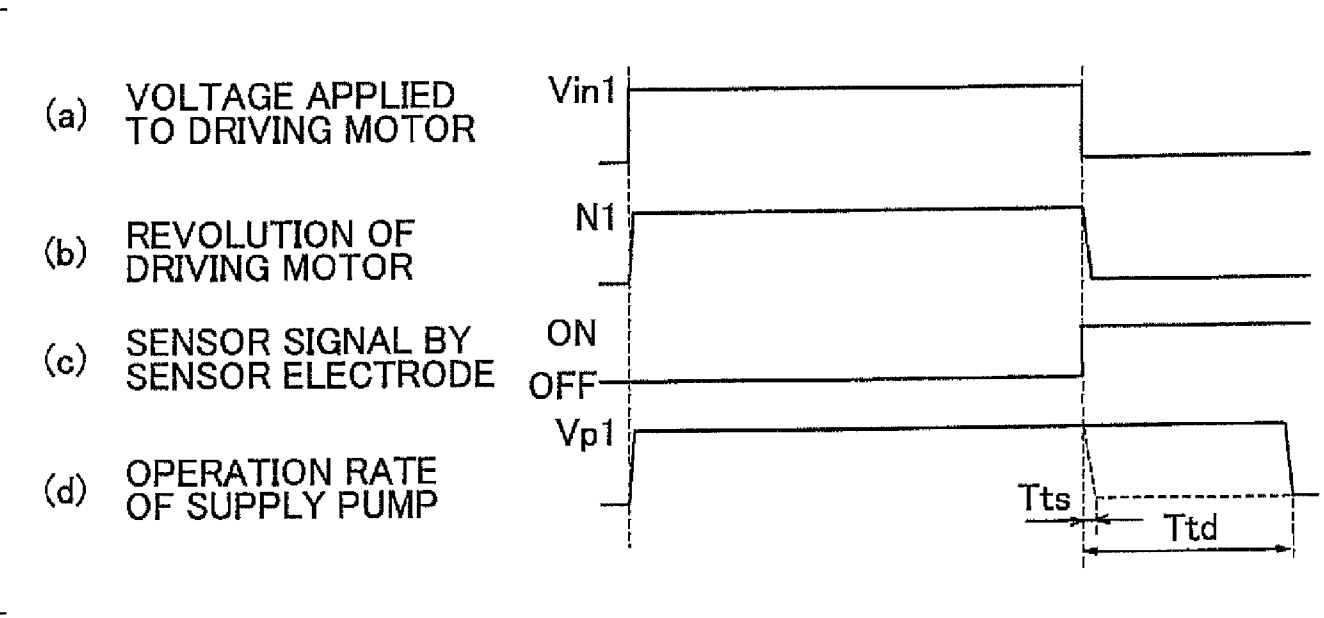
FIG. 28 is a timing chart referred for describing a comparison example 2.
Figure 29:
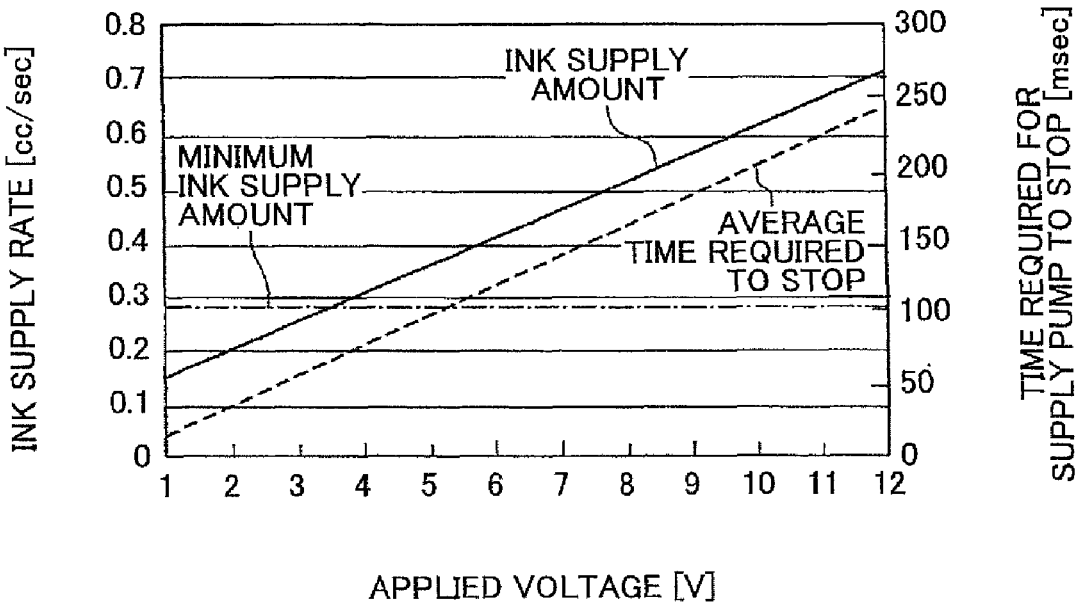
FIG. 29 is a diagram referred for describing a relationship among a voltage applied to a driving motor, an ink supply rate, and time required to stop the ink supply.
Figure 30:
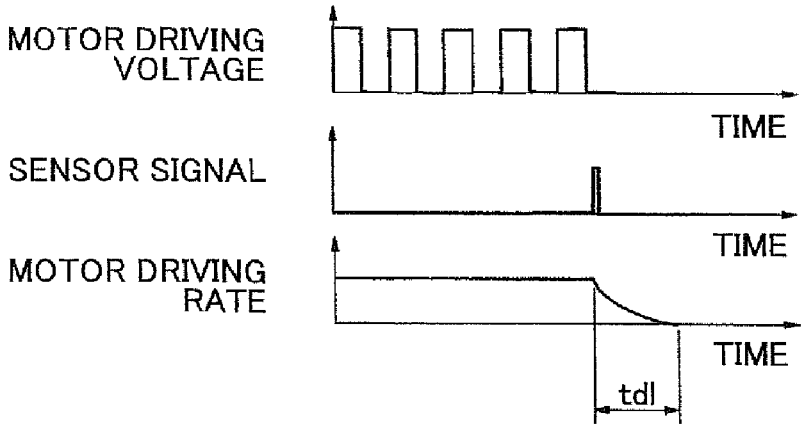
FIG. 30 is a diagram referred for describing a relationship between a voltage applied to a driving motor and time required for the driving motor to stop.
Figure 31:
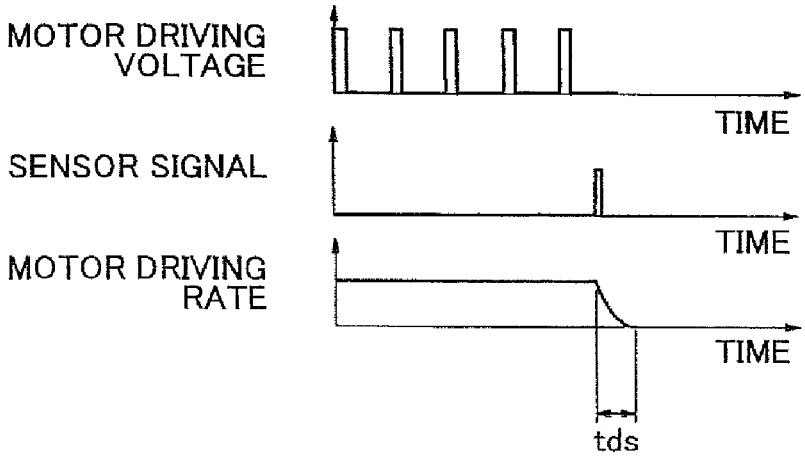
FIG. 31 is a diagram referred for describing a relationship between a voltage applied to a driving motor and time required for the driving motor to stop.

Next, an eleventh embodiment of the invention is described with reference to FIGS. 25 and 26. FIG. 25 shows a timing chart described in this embodiment. FIG. 26 is a view showing a subtank referred for describing a timing to change the ink supply rate.

In this embodiment, the sensor electrodes 310 are used as amount sensors to sense the ink surface in the subtank 25. Similarly to the sixth embodiment, the ink supply rate is decreased in a staged manner. In this case, the ink surface contacts the sensor electrodes 310 at a level P1, a full amount level of the ink is P2, and a level between P1 and P2 is P3. The ink supply rate is decreased at timings when the ink surface reaches the levels P1 and P3.

That is, the pump driving motor 305 is driven so that the ink supply rate of the supply pump 301 is Vp11 until a sensor signal is outputted by the sensor electrodes 310. When the sensor signal is outputted by the sensor electrodes 310, the pump driving motor 305 is driven so that the ink supply rate of the supply pump 301 is decreased to Vp12 (Vp12<Vp11). When predetermined time Tt2 (time required until the ink surface reaches the level P3) has passed after the sensor signal is outputted by the sensor electrodes 310, the pump driving motor 305 is driven so that the ink supply rate of the supply pump 310 becomes Vp13 (Vp13<Vp12). When the allowable time Tt1 has passed after the ink amount in the subtank 25 is at the level P1, the pump driving motor 305 stops the supply pump 301.

In this manner, by decreasing the ink supply rate of the supply pump in a staged manner, the supply pump can be stopped more precisely when the ink is at a desired supply level. As the ink supply rate is higher, it takes shorter to supply the desired amount of ink. However, with too high ink supply rate, variations in the ink supply amount cannot be reduced much even when the ink supply rate is decreased by one stage. Therefore, by decreasing the ink supply rate by plural stages, there are less variation in the timing that the supply pump stops.

This patent application is based on Japanese Priority Patent Application No. 2007-303157 filed on Nov. 22, 2007, the entire contents of which are hereby incorporated herein by reference.

The invention claimed is:

1. An image forming apparatus comprising:

a print head to eject droplets;

a subtank to supply ink to the print head;

a main tank to supply the ink to the subtank;

a supply pump to supply the ink from the main tank to the subtank;

a pump driver to drive the supply pump in response to a driving voltage supplied to the pump driver;

an amount sensor to sense an ink amount in the subtank and output a signal when the ink amount in the subtank is at a predetermined level; and a unit to supply the driving voltage to the pump driver to drive and control the pump driver, wherein the unit is configured to decrease an ink supply rate of the supply pump, by changing the driving voltage applied to the pump driver from a first voltage value Vin1 to a second voltage value Vin2 where Vin1>Vin2>0, to cause the pump driver to change an operation rate of the supply pump from a normal operation rate Vp1 to a lower operation rate Vp2, where Vp1>Vp2>0, in response to the signal outputted by the amount sensor indicating that the ink amount in the subtank is at the predetermined level, and to stop the supply pump, by no longer applying the driving voltage to the pump driver when a predetermined allowable time Tt1 for operation at the lower operation rate Vp2 has passed after the signal indicating that the ink amount in the subtank is at the predetermined level is outputted by the amount sensor.

2. The image forming apparatus as claimed in claim 1, wherein the ink supply rate of the supply pump is decreased immediately upon the outputting of the signal from the amount sensor.

3. The image forming apparatus as claimed in claim 1, wherein the ink supply rate of the supply pump is decreased when predetermined time has passed after the signal is outputted by the amount sensor.

4. The image forming apparatus as claimed in claim 1, wherein the driving voltage applied to the pump driver is decreased so that a stall torque of the pump driver becomes smaller than a driving load of the supply pump when decreasing the ink supply rate of the supply pump.

5. The image forming apparatus as claimed in claim 1, further comprising another supply pump, wherein the pump driver is configured to drive the supply pumps, which is configured to drive one of the supply pumps when the pump driver rotates in a positive rotation direction and drives the other supply pump when the pump driver rotates in a negative rotation direction.

6. The image forming apparatus as claimed in claim 1, wherein the ink supply rate of the supply pump is decreased by at least two stages.

7. The image forming apparatus as claimed in claim 6, wherein the ink supply rate of the supply pump is decreased when the amount sensor senses the ink at a first predetermined level and when the amount sensor senses the ink at a second predetermined level which is closer to a full amount level than the first predetermined level.

8. The image forming apparatus as claimed in claim 1, wherein the amount sensor has a member which displaces in accordance with the ink amount in the subtank and a sensor to sense the member.

9. The image forming apparatus as claimed in claim 1, wherein the amount sensor includes a unit to sense an ink surface in the subtank.

10. The image forming apparatus as claimed in claim 1, wherein:

the subtank includes a tank case for holding ink, with one side opened, the open side of the tank case is sealed with a flexible film that is biased outwards by an elastic member provided in the tank case such that a negative pressure is generated when the ink in the tank case decreases;

the image forming apparatus further comprises a sensor feeler displaceably provided outside the tank case, the sensor feeler having one end supported by a fulcrum so as to be able to fluctuate, and is pressed by a rotation spring to contact a top portion of the biased film such that when the ink in the subtank increases or decreases, a tip sensor piece of the sensor feeler moves; and the amount sensor is configured to sense the position of the sensor feeler, which is configured to displace in response to an increase in the ink amount in the subtank, the amount sensor being configured such that when the ink amount reaches the predetermined level, the amount sensor senses the sensor feeler and outputs the sensor signal.

11. The image forming apparatus as claimed in claim 1, wherein:

the amount sensor is configured to sense the ink amount in the subtank at the predetermined level which is less than a full mount level by an amount supplied when the supply pump operates at the lower operation rate Vp2 for the predetermined allowable time Tt1.

* * * * *